US008672440B2

(12) United States Patent
Itogawa

(10) Patent No.: US 8,672,440 B2
(45) Date of Patent: Mar. 18, 2014

(54) LIQUID EJECTING APPARATUS INCLUDING CURL CORRECTING DEVICE, LIQUID EJECTING METHOD INCLUDING CURL CORRECTING PROCESS, AND COMPUTER-READABLE MEDIA FOR LIQUID EJECTION AND CURL CORRECTING

(71) Applicant: Yoshihiro Itogawa, Mizuho (JP)

(72) Inventor: Yoshihiro Itogawa, Mizuho (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/721,756

(22) Filed: Dec. 20, 2012

(65) Prior Publication Data

US 2013/0257957 A1 Oct. 3, 2013

(30) Foreign Application Priority Data

Mar. 30, 2012 (JP) ..... 2012-081897

(51) Int. Cl.
*B41J 29/38* (2006.01)

(52) U.S. Cl.
USPC ..... 347/16; 347/14; 347/19; 347/104; 347/105

(58) Field of Classification Search
USPC ..... 347/14, 16, 19, 101, 104, 105
See application file for complete search history.

(56) References Cited

U.S. PATENT DOCUMENTS

| | | | | |
|---|---|---|---|---|
| 7,383,017 | B2 * | 6/2008 | Ushio | 399/406 |
| 2009/0073211 | A1 | 3/2009 | Imoto | |
| 2009/0147039 | A1 | 6/2009 | Koase | |

FOREIGN PATENT DOCUMENTS

| | | | |
|---|---|---|---|
| JP | 2009-066905 | A | 4/2009 |
| JP | 2009-143010 | A | 7/2009 |

* cited by examiner

*Primary Examiner* — Juanita D Jackson
(74) *Attorney, Agent, or Firm* — Baker Botts L.L.P.

(57) ABSTRACT

A liquid ejecting apparatus includes a liquid ejection head that ejects liquid on recording media, an output tray that supports the recording media stacked thereon, a curl-correcting device, a detecting device, and a controller. The curl-correcting device performs curl-correction processing on the recording media, which reduces an amount of curl of the recording media. The detecting device detects information related to a stacking thickness of the recording media. The controller sets the curl-correcting device to perform the curl-correction processing on the recording media at a first processing level when the stacking thickness is greater than or equal to the threshold stacking thickness. The controller sets the curl correcting device to perform the curl-correction processing on the recording media at a second processing level when the stacking thickness is less than the threshold stacking thickness. The first processing level includes more curl-correction processing than the second processing level.

18 Claims, 17 Drawing Sheets

Fig.7

| STACKING THICKNESS | WAITING TIME |
|---|---|
| 1 cm | 0.5 sec (T) |
| 2 cm | 0.5 sec (T) |
| ⋮ | ⋮ |
| 5 cm | 0.6 sec |
| 6 cm | 0.8 sec |
| 7 cm | 1.2 sec |
| ⋮ | ⋮ |

T0

STACKING-THICKNESS THRESHOLD

Fig.9

| | T1 FIRST TABLE | T2 SECOND TABLE |
|---|---|---|
| STACKING THICKNESS | WAITING TIME | WAITING TIME |
| 1 cm | 0.5 sec | 0.7 sec |
| 2 cm | 0.5 sec | 0.7 sec |
| ⋮ | ⋮ | ⋮ |
| 5 cm | 0.6 sec | 0.8 sec |
| 6 cm | 0.8 sec | 1.0 sec |
| 7 cm | 1.2 sec | 1.4 sec |
| ⋮ | ⋮ | ⋮ |

Fig.11A

BLACK

| | a | b | c | d | e | f |
|---|---|---|---|---|---|---|
| 1 | | | M | M | M | |
| 2 | | | M | | | |
| 3 | | L | M | | | |
| 4 | | | | | | |
| 5 | | | | | | |
| 6 | | | | | | |

Fig.11B

CYAN

| | a | b | c | d | e | f |
|---|---|---|---|---|---|---|
| 1 | | | | | | |
| 2 | | | | | | |
| 3 | | | | | | |
| 4 | | M | | | | |
| 5 | | L | M | | | |
| 6 | | | | | | |

PAPER TRANSPORT DIRECTION

Fig.11C

MAGENTA

| | a | b | c | d | e | f |
|---|---|---|---|---|---|---|
| 1 | | | | | | |
| 2 | | | | | | |
| 3 | | | | | | |
| 4 | | | | | S | |
| 5 | | | | L | M | |
| 6 | | M | S | M | | |

Fig.11D

YELLOW

| | a | b | c | d | e | f |
|---|---|---|---|---|---|---|
| 1 | | | | | | |
| 2 | | | | S | S | |
| 3 | | | | S | S | |
| 4 | | S | | S | S | |
| 5 | | L | M | S | M | |
| 6 | | | | | | |

Fig.14

T3

| STACKING THICKNESS | FIRST WAITING TIME | SECOND WAITING TIME |
|---|---|---|
| 1 cm | 0.5 sec (T) | 0.7 sec |
| 2 cm | 0.5 sec (T) | 0.7 sec |
| ⋮ | ⋮ | ⋮ |
| 5 cm | 0.6 sec | 0.8 sec |
| 6 cm | 0.8 sec | 1.0 sec |
| 7 cm | 1.2 sec | 1.4 sec |
| ⋮ | ⋮ | ⋮ |

STACKING-THICKNESS THRESHOLD

T3

| CURL-AMOUNT THRESHOLD |
|---|
| 2 cm |
| 2 cm |
| ⋮ |
| 1 cm |
| 1 cm |
| 1 cm |
| ⋮ |

FIRST CURL AMOUNT

SECOND CURL AMOUNT

LIQUID EJECTING APPARATUS INCLUDING CURL CORRECTING DEVICE, LIQUID EJECTING METHOD INCLUDING CURL CORRECTING PROCESS, AND COMPUTER-READABLE MEDIA FOR LIQUID EJECTION AND CURL CORRECTING

CROSS REFERENCE TO RELATED APPLICATION

This application claims priority from Japanese Patent Application No. 2012-081897, filed on Mar. 30, 2012, the disclosure of which is incorporated herein by reference.

BACKGROUND OF THE INVENTION

1. Field of the Invention

The present invention relates generally to image recording and more specifically to a liquid ejecting apparatus including a curl correcting device, liquid ejecting method including a curl correcting process, and computer-readable media for liquid ejection and curl correcting.

2. Description of Related Art

A known liquid ejecting apparatus is an ink jet recording apparatus that ejects ink toward a sheet of a recording medium, such as paper or film, and records an image on the recording medium. The ink used in the ink jet recording apparatus includes water as the solvent. The water content in the ink causes a curl to occur in the recording medium to after the ink is attached during an image formation process. When the curl is greater than or equal to a certain size, the recording medium does not stack neatly on an output tray after being discharged. Consequently, a defect in the recording medium, such as bending or warping, often occurs. A known ink jet recording apparatus that addresses the above issue estimates the size of curling (hereinafter referred to as "curl amount") after the image formation process, sets a waiting time based on the curl amount, and discharges the recording medium after the waiting time may comprise elapsed from the end of the image formation process. The waiting time is a period of time sufficient for the curl amount to be reduced to an amount that is less than the certain amount.

SUMMARY OF THE INVENTION

When many recording media may be stacked on an output tray, the uppermost recording medium may be disposed near the output port for recording media. Even when the curl amount of the uppermost recording medium is small, a recording medium discharged after the uppermost recording medium may collide with the uppermost recording medium and each may suffer from a defect, such as bending or warping. The known ink jet recording apparatus may set a waiting time based on the curl amount, such that the curl of the recording medium may be corrected.

Even when a small curl remains in the recording media, the recording media may be discharged at a reduced throughput (e.g., the time from the start of image formation to the end of discharging recording media with the images recorded thereon to the output tray). Nevertheless, when the uppermost recording medium is disposed near the output port for recording media, the possibility of a collision between the uppermost recording medium and the next discharged recording medium may be not avoided.

A liquid ejecting apparatus and method for correcting a curl disclosed herein may reduce collisions between the uppermost recording medium on an output tray and a recording medium that may be subsequently discharged to the output tray.

A liquid ejecting apparatus disclosed herein may comprise a liquid ejection head, an output tray, a curl correcting device, a detecting device, and a controller. The liquid ejection head may be configured to eject liquid on each piece of at least one piece of recording media. The output tray may be configured to support the at least one piece of recording media stacked thereon. The curl correcting device may be configured to perform curl correction processing on the each piece of the at least one piece of recording media before the each piece of the at least one piece of recording media is discharged to the output tray. The curl correction processing may reduce an amount of curl of the each piece of the at least one piece of recording media. The detecting device may be configured to detect information related to a stacking thickness of the at least one piece of recording media stacked on the output tray in a stacking direction thereof. The controller may be configured to determine whether the stacking thickness is greater than or equal to a threshold stacking thickness based on the information related to the stacking thickness. The controller may be configured to set the curl correcting device to perform the curl correction processing on the each piece of the at least one piece of recording media at a first processing level when the stacking thickness is greater than or equal to the threshold stacking thickness. The controller may be configured to set the curl correcting device to perform the curl correction processing on the each piece of the at least one piece of recording media at a second processing level when the stacking thickness is less than the threshold stacking thickness. The first processing level may comprise a greater amount of curl correction processing than the second processing level.

A method for correcting a curl disclosed herein may be performed with a liquid ejecting apparatus. The liquid ejecting apparatus may comprise a liquid ejection head, an output tray, a curl correcting device, and a detection device. The liquid ejection head may be configured to eject liquid on each piece of at least one piece of recording media. The output tray may be configured to support the at least one piece of recording media stacked thereon. The curl correcting device may be configured to perform curl correction processing on the each piece of the at least one piece of recording media before the each piece of the at least one piece of recording media is discharged to the output tray. The detecting device may be configured to detect information related to a stacking thickness of the at least one piece of recording media stacked on the output tray in a stacking direction thereof. The method may comprise a step of determining whether the stacking thickness is greater than or equal to a threshold stacking thickness based on the information related to the stacking thickness. The method may comprise a step of setting the curl correcting device to perform the curl correction processing on the each piece of the at least one piece of recording media at a first processing level when the stacking thickness is greater than or equal to the threshold stacking thickness. The method may comprise a step of setting the curl correcting device to perform the curl correction processing on the each piece of the at least one piece of recording media at a second processing level when the stacking thickness is less than the threshold stacking thickness. The curl correction processing may reduce an amount of curl of the each piece of the at least one piece of recording media. The first processing level may comprise a greater amount of curl correction processing than the second processing level.

A non-transitory, computer-readable medium disclosed herein may store computer-readable instructions therein.

When executed by a processor of a liquid ejecting apparatus, the computer-readable instructions may instruct the processor to execute certain steps. The liquid ejecting apparatus may comprise a liquid ejection head, an output tray, a curl correcting device, and a detection device. The liquid ejection head may be configured to eject liquid on each piece of at least one piece of recording media. The output tray may be configured to support the at least one piece of recording media stacked thereon. The curl correcting device may be configured to perform curl correction processing on the each piece of the at least one piece of recording media before the each piece of the at least one piece of recording media is discharged to the output tray. The detecting device may be configured to detect information related to a stacking thickness of the at least one piece of recording media stacked on the output tray in a stacking direction thereof. The computer-readable instructions may instruct the processor to execute a step of determining whether the stacking thickness is greater than or equal to a threshold stacking thickness based on the information related to the stacking thickness. The computer-readable instructions may instruct the processor to execute a step of setting the curl correcting device to perform the curl correction processing on the each piece of the at least one piece of recording media at a first processing level when the stacking thickness is greater than or equal to the threshold stacking thickness. The computer-readable instructions may instruct the processor to execute a step of setting the curl correcting device to perform the curl correction processing on the each piece of the at least one piece of recording media at a second processing level when the stacking thickness is less than the threshold stacking thickness. The curl correction processing may reduce an amount of curl of the each piece of the at least one piece of recording media. The first processing level may comprise a greater amount of curl correction processing than the second processing level.

Another liquid ejecting apparatus disclosed herein may comprise a liquid ejection head, an output tray, a curl correcting device, a position determining device, and a controller. The liquid ejection head may be configured to eject liquid on each piece of at least one piece of recording media. The output tray may be configured to support the at least one piece of recording media stacked thereon. The curl correcting device may be configured to perform curl correction processing on the each piece of the at least one piece of recording media before the each piece of the at least one piece of recording media is discharged to the output tray. The curl correction processing may reduce an amount of curl of the each piece of the at least one piece of recording media. The position determining device may be configured to determine position information of an uppermost piece of the at least one piece of recording media stacked on the output tray in a stacking direction. The controller may be configured to determine whether the uppermost piece is at a level of or above the level of a particular position based on the position information of the uppermost piece. The controller may be configured to set the curl correcting device to perform the curl correction processing on the each piece of the at least one piece of recording media at a first processing level when the uppermost piece is at the level of or above the level of the particular position. The controller may be configured to set the curl correcting device to perform the curl correction processing on the each piece of the at least one piece of recording media at a second processing level when the uppermost piece is below the level of the particular position. The first processing level may comprise a greater amount of curl correction processing than the second processing level.

When the thickness of recording media on the output tray in the stacking direction is greater than or equal to a threshold thickness and the curl amount of a recording medium is greater than or equal to a certain size, there may be a possibility that the uppermost recording medium and a recording medium that may be subsequently discharged to the output tray may collide with each other, and the recording media may not stack neatly. Accordingly, when the thickness of recording media on the output tray in the stacking direction exceeds the threshold, the degree of correction of the curl of the subsequently discharged recording medium may be increased to sufficiently correct the curl. Increasing the degree of correction may reduce the likelihood of a collision between the uppermost recording medium stacked on the output tray and a recording medium that may be subsequently discharged to the output tray.

Other objects, features, and advantages will be apparent to persons of ordinary skill in the art from the following detailed description of embodiments of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

FIG. 7 is a diagrammatic view that shows an exemplary table used by a waiting-time setting device;

FIG. 9 is a diagrammatic view that shows exemplary tables used by the waiting-time setting device according to certain configurations;

FIG. 11A is a diagrammatic view that shows data for black ink ejection according to further configurations, FIG. 11B is a diagrammatic view that shows data for cyan ink ejection according to the further configurations, FIG. 11C is a diagrammatic view that shows data for magenta ink ejection according to the further configurations, and FIG. 11D is a diagrammatic view that shows data for yellow ink ejection according to the further configurations;

FIG. 14 is a diagrammatic view that shows an exemplary table used by a curl correcting amount setting device according to the other configurations of FIG. 13;

DETAILED DESCRIPTION OF EMBODIMENTS OF THE INVENTION

Embodiments of the present invention may be described below using the drawings. In the embodiments, a sheet of paper P is shown as an example of a recording medium, and an ink jet recording apparatus that ejects ink (e.g., ink with a water-based solvent) toward the sheet of paper P is shown as an example of a liquid ejecting apparatus. Nevertheless, the invention is not limited to the above-described examples, and recording media may comprise, for example, one or more of fabrics, plastics, cardboard, and other materials susceptible to curling, and liquid ejecting apparatuses may comprise, for example, an apparatus that ejects other liquids.

Figure 1:
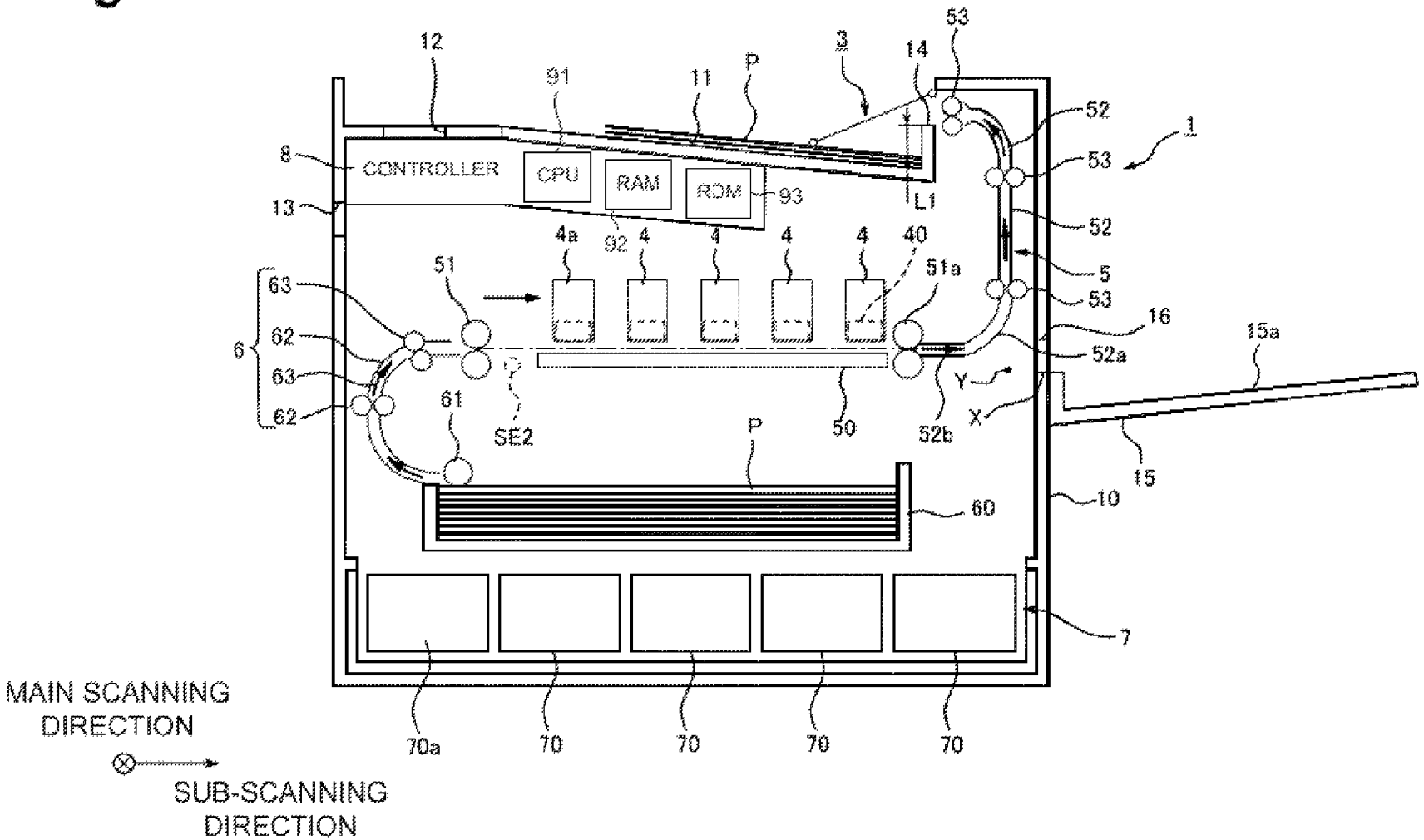
FIG. 1 is a side view that shows a schematic illustration of an ink jet recording apparatus.

FIG. 1 shows an overall configuration of the ink jet recording apparatus. An ink jet recording apparatus 1 may comprise a casing 10 having a shape substantially similar to a rectangular parallelepiped and an output tray 11 in the upper portion of the casing 10. The output tray 11 may be positioned lower than an output port 14 in the casing 10. As described below, sheets of printed paper P may be discharged through the output port 14 and may be stacked on the output tray 11. Liquid ejection heads 4, a transport device 5, a paper feed device 6, and a tank group 7 may be arranged in the casing 10, as depicted in FIG. 1. The liquid ejection heads 4 individually may eject ink droplets of one or more of black, cyan, magenta, and yellow to the sheet of paper P. The transport device 5 may transport horizontally the sheet of paper P with ink ejected thereon and may continue the horizontal transportation of the sheet of paper P or may convey the sheet of paper P to the output tray 11. The casing 10 may define an opening 16 in a side surface thereof at a position corresponding to an extension of the horizontal travel path formed by the transport device 5. A face-up output tray 15 may be disposed on the outside of the casing 10 at a position lower than the opening 16. The face-up output tray 15 may pivot about a contact X, which may be in contact with the side surface of the casing 10, and may comprise a medium-placed face 15*a* for receiving the sheet of paper P thereon. As shown in FIG. 1, the state in which the medium-placed face 15*a* may be placed face-up may be referred to as the open state of the face-up output tray 15, and the state in which the face-up output tray 15 may be pivoted about the contact X counterclockwise from the open state such that the medium-placed face 15*a* may face the side of the casing 10 may be referred to as the closed state of the face-up output tray 15.

The sheets of printed paper P having passed through the opening 16 may be stacked on the face-up output tray 15 in the open state. Accordingly, the sheets of printed paper P may be discharged selectively to one or more of the output tray 11 and the face-up output tray 15, and the choice between the output tray 11 and the face-up output tray 15 in discharging the sheet of paper P may depend on input, as described below. The sheet of paper P may be discharged to the output tray 11 such that the surface with the ink ejected thereon may be placed face-down. Accordingly, the output tray 11 may support face-down printing.

In contrast, the sheet of paper P may be discharged to the face-up output tray 15 such that the face with ink ejected thereon may be placed face-up. Accordingly the face-up output tray 15 may support face-up printing.

The paper feed device 6 may supply the sheet of paper P to the transport device 5. The tank group 7 may comprise a plurality of tanks 70 storing respective colors of ink. A process-liquid head 4*a*, from which a process liquid may be ejected to the sheet of paper P before ejection of ink, may be disposed downstream of the paper feed device 6 and upstream of the liquid ejection heads 4. The process liquid may be applied to the sheet of paper P before ink is ejected to the sheet of paper P to cause one or more of aggregation of an ingredient of the ink and precipitation of an ingredient of the ink. For example, the process liquid may enable a high printing quality to be maintained, may enhance the image quality, or both. The tank group 7 also may comprise a process-liquid tank 70*a* storing the process liquid.

A controller 8 that may be configured to control the devices and electric circuits in the casing 10 may be arranged in the upper portion inside the casing 10 in a location that may not interfere with the liquid ejection heads 4. A terminal 13 that may be configured to receive information (e.g., a print job) from an information recording apparatus (e.g., a personal computer) outside of the casing 10. The print job from the information recording apparatus may be input through the terminal 13 into the controller 8.

An operation panel 12 may connect electrically to the controller 8 and may be disposed on a surface of the casing 10, such as, for example, the top surface. The operation panel 12 may be used to switch between discharging the sheet of paper P to the output tray 11 and discharging the sheet of paper P to the face-up output tray 15.

The transport device 5 may be the device for transporting the sheet of paper P in the printing region adjacent to the liquid ejection heads 4 along the direction of the horizontal arrow in FIG. 1. Subsequently, the transport device 5 may transport the sheet of paper P in an upward direction toward the output tray 11 when the sheet of paper P is to be discharged to the output tray 11. In the following description, the direction in which the sheet of paper P may be transported in the printing region may be referred to as the sub-scanning direction, and the direction perpendicular to the sub-scanning direction in a horizontal plane may be referred to as the main scanning direction.

The transport device 5 may comprise a platen 50, pairs of transport rollers 51 and 51*a* adjacent to both sides of the platen 50, and guides 52, 52*a*, and 52*b* and pairs of advancing rollers 53 that are disposed between the transport rollers 51*a* and the output tray 11. The guide 52 may extend in a substantially vertical direction toward the output tray 11. The guide 52*a* may be positioned below the guide 52 and may comprise an arc shape that protrudes outward. The guide 52*b* may be contiguous to the guide 52*a* and may extend in the substantially horizontal direction. The arc-shaped guide 52*a* may be detachable from the guides 52 and 52*b*. The guide 52*a* may rotate about a virtual point Y shown in FIG. 1. The guide 52*a* and the face-up output tray 15 may be rotated independently by respective dedicated motors (not shown).

The sheet of paper P, which has received a transport force applied by the pair of transport rollers 51 on the upstream side in the transport direction, may be transported while being supported by the top surface of the platen 50. The sheet of paper P receives a transport force applied by the pair of transport rollers 51*a* on the downstream side in the transport direction after at least a portion of the sheet of paper P passes along the platen 50.

The transport route of the sheet of paper P after it has passed along the platen 50 may be determined based on whether face-down printing or face-up printing is to be performed, as described below.

Figure 2A:
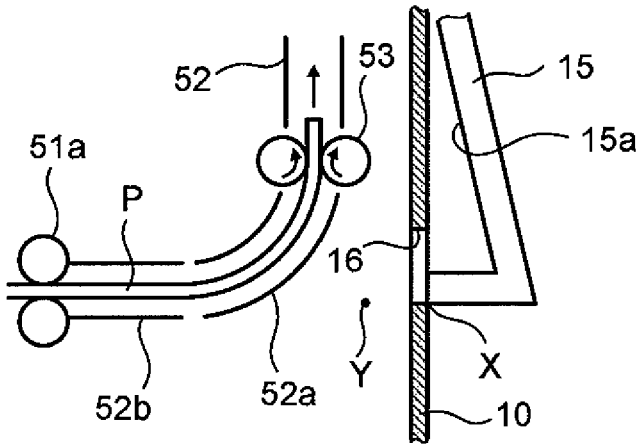
FIG. 2A is a side view that shows a schematic illustration of a transport route of a sheet of paper P in face-down printing.
Figure 2B:
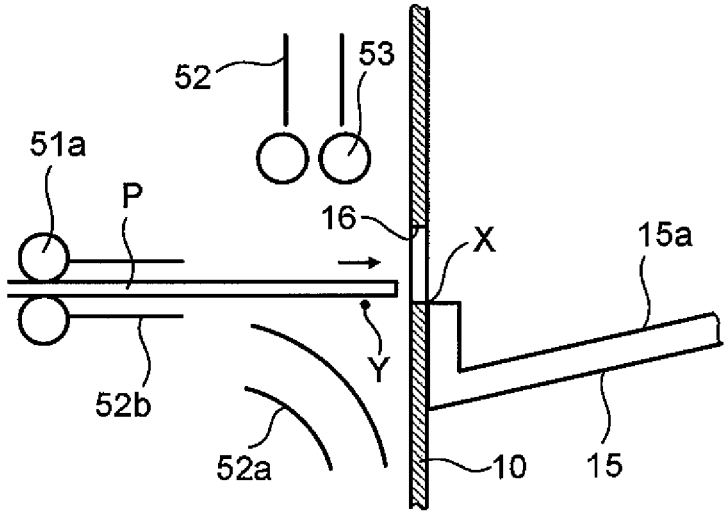
FIG. 2B is a side view that shows a schematic illustration of a transport route of the sheet of paper P in face-up printing.

FIG. 2A shows a transport route of paper P in face-down printing, and FIG. 2B shows in the transport route of paper P in face-up printing. As shown in FIG. 2A, in face-down printing, the face-up output tray 15 may be closed, and the guide 52*a* may be arranged in a location contiguous to the guides 52*b* and 52. The sheet of paper P transported by the pair of transport rollers 51*a* may be transported toward the output tray 11 by the guides 52*b*, 52*a*, and 52.

As shown in FIG. 2B, the guide 52*a* rotates downward about the virtual point Y and may be arranged in a location remote from the guides 52*b* and 52, such that the sheet of paper P subjected to face-up printing may be conveyed to the face-up output tray 15 in an open state. The sheet of paper P transported by the pair of transport rollers 51*a* may be transported through the opening 16 to the medium-placed face 15*a* of the face-up output tray 15. Accordingly, the guide 52*a* may be not an obstacle to the transportation of the sheet of paper P to the face-up output tray 15.

The paper feed device 6 may comprise a paper feed tray 60, a paper feed roller 61, and two guides 62 and two pairs of advancing rollers 63 disposed between the paper feed roller 61 and the transport device 5. The paper feed roller 61 may pick up the uppermost sheet of paper P on the paper feed tray 60, and the uppermost sheet of paper P may be transported to the upstream side of the transport device 5 by the guides 62 and the pairs of advancing rollers 63.

Each of the liquid ejection heads 4 may be a line head that extends in the main scanning direction and may comprise a substantially rectangular parallelepiped shape. The bottom surface of the liquid ejection head 4 may be a nozzle surface 40 comprising many liquid ejection orifices from which ink may be ejected. Each of the liquid ejection heads 4 may be connected with a tube (not shown) to a tank 70 corresponding to the color of ink to be ejected. The ink droplets may be ejected through the liquid ejection orifices in the nozzle surface 40. The ejected ink droplets may be classified into, for example, three types (e.g., large, medium, and small), depending on the size of the diameter of each of the ejected ink droplets.

A portion of the transport device 5 and a heater 20, which is described below, may form a curl correcting device 2. When the curl amount of a sheet of paper P with ink thereon is greater than or equal to a certain amount, the discharged printed paper P may be not neatly stacked and may suffer from a defect, such as, for example, bending or warping. The curl correcting device 2 may be used for discharging the printed paper P to the output tray 11 after correcting the curl amount of printed paper P to less than the certain amount.

Figure 3:
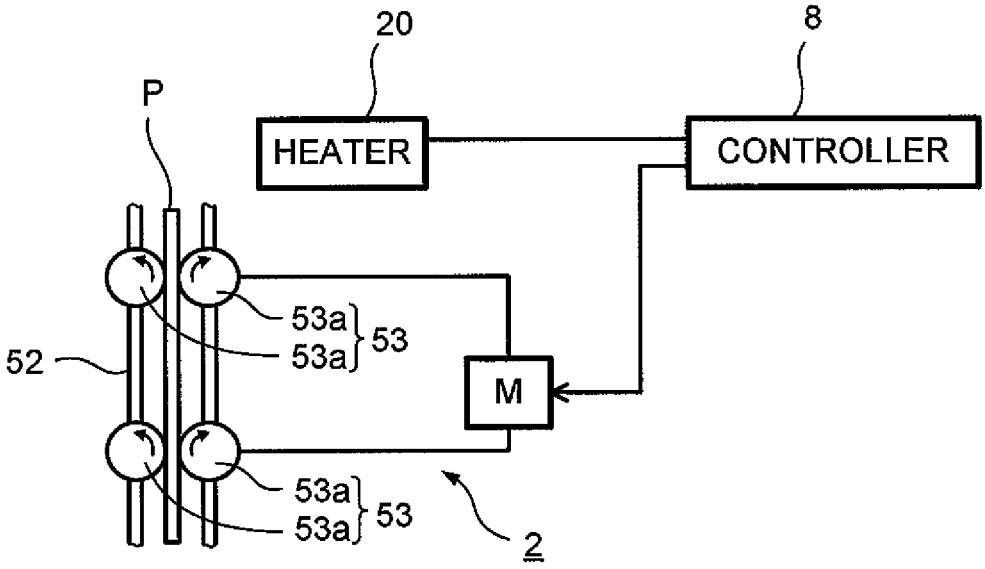
FIG. 3 is a diagrammatic view that shows a schematic illustration of a curl correcting device.

FIG. 3 shows a detailed configuration of the curl correcting device 2. Each of the pairs of advancing rollers 53 may comprise two advancing rollers 53*a* urged toward each other. Each of the advancing rollers 53*a* may pass through a hole (not shown) in the guide 52 and may enter the transport route for a sheet of paper P. The sheet of paper P may be pinched and transported by both of the advancing rollers 53*a*, which may be connected to a motor M and rotated by the motor M.

In the course of pinching and transporting the sheet of paper P by both of the advancing rollers 53*a*, the rotation of the motor M may be stopped, the sheet of paper P may stop in the transport route, and the sheet of paper P may be brought into a waiting state. In the waiting state a first portion of the sheet of paper P may be held in place by a first pair of rollers 53*a* and a second portion of the sheet of paper P may be held in place by a second pair of rollers 53*a*, such that the sheet of paper P may be stretched straight and the shape of the sheet of paper P may be retained. Continuing this waiting state for a predetermined time may permit the ink on the sheet of paper P to dry and may correct the curl of the sheet of paper P. The predetermined time for which the waiting state may be continued may be referred to as a waiting time.

Alternatively or additionally, the curl may be corrected by rotating the motor M at a reduced speed and transporting the sheet of paper P at a reduced speed that is less than a normal transport speed. Consequently, the ink on the sheet of paper P may have additional time to dry while the sheet of paper P is transported at the reduced speed.

The heater 20 may be adjacent to a side of the advancing rollers 53*a*. When the heater 20 blows a warm current of air, the sheet of paper P transported by the advancing rollers 53*a* may be exposed to the warm current of air and may be heated. When a warm current of air is blown by the heater 20 while the sheet of paper P is in a waiting state or while the sheet of paper P is transported at a low speed, drying of the sheet of paper P may be facilitated. Accordingly, correction of the curl of the sheet of paper P may be facilitated.

The motor M and the heater 20 comprised in the curl correcting device 2 may be connected to the controller 8. The waiting time of the motor M may be controlled by the controller 8. The heating time and heating temperature of the heater 20 may be controlled by the controller 8. The waiting time, heating time, and heating temperature set by the curl correcting device 2 to reduce the curl of the sheet of paper P (e.g., a curl correcting process) may be collectively referred to as the curl correcting amount. The curl correcting device 2 corrects the curl amount of the sheet of paper P to less than the certain amount, as described above. The degree of correction from the state in which the curl of the sheet of paper P is not corrected (e.g., a curled state) to the state in which the curl amount is zero or substantially reduced (e.g., an uncurled state) may be referred to as the degree of correction of a curl. Alternatively, the degree of correction of a curl may be the difference between the amount of curl (e.g., the amount of flexure of the sheet of paper P) occurring when the sheet of paper P is discharged to the output tray 11 without being subjected to curl correction (e.g., an uncorrected state) and the amount of curl occurring when the sheet of paper P is discharged to the output tray 11 after its curl is corrected (e.g., a corrected state).

The heater 20 in the curl correcting device 2 is optional. Accordingly, setting the sheet of paper P in the waiting state without using the heater 20 still may correct a curl of the sheet of paper P. Further, reduced-speed transportation of the sheet of paper P without using the heater 20 still may correct a curl of the sheet of paper P.

Figure 4:
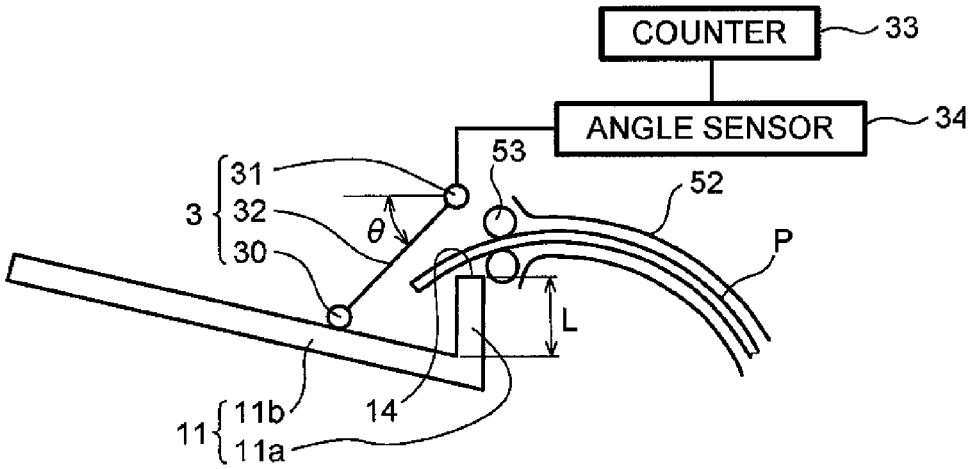
FIG. 4 is a side view that shows a schematic illustration of an output tray.

FIG. 4 shows a schematic representation of the output tray 11. The face-up output tray 15 may comprise substantially the same configuration and a detailed description thereof is omitted herein. Consequently, the configuration of the output tray 11 now is described.

The output tray 11 may comprise a substantially vertical wall 11*a* extending in a substantially vertical direction and a bottom board 11*b* extending from the lower end of the vertical wall 11*a* in an upward angled direction. The upper end of the vertical wall 11*a* may be positioned at a lower end of the output port 14. The distance between the upper end of the vertical wall 11*a* and the lowermost part of the upper surface of the bottom board 11*b* may be L. A pendulum device 3 may be disposed substantially above the bottom board 11*b* inside the casing 10.

The pendulum device 3 may comprise a rotation center shaft 31, which may be attached to the casing 10 at a position substantially above the vertical wall 11*a*; a contact 30, which may contact with the sheet of paper P discharged through the output port 14 to the bottom board 11*b*; and a connecting rod 32, which may connect the rotation center shaft 31 and the contact 30. Together, the contact 30 and the connecting rod 31 may be referred to as an arm. The contact 30 and the connecting rod 32 may be rotatable about the rotation center shaft 31. The connecting rod 32 may be made of a light member, such that the connecting rod 32 may not interfere with a falling sheet of paper P discharged through the output port 14 to the bottom board 11*b*. The connecting rod 32 may be positioned adjacent to the side of discharging paper P with respect to the output port 14. The sheet of paper P discharged through the output port 14 may slide along the bottom board 11*b* or along the previously discharged sheet of paper P, which is supported by the bottom board 11*b*, in an upward slanting direction. Subsequently, the sheet of paper P may come into contact with the contact 30 and may raise the contact 30 by the thickness of the sheet of paper P. The rotation center shaft 31 may be provided with an angle sensor 34. The angle sensor 34 may be connected to a counter 33. The angle between the connecting rod 32 and a horizontal line may be θ. When the sheet of paper P is stacked on the bottom board 11*b*, the contact 30 may rise and the rotation center shaft 31 may rotate. This movement may change the value of the angle θ, and the counter 33 may calculate the stacking thickness of paper P in the stacking direction of the sheet of paper P (e.g., vertical direction or direction of the thickness of the sheets of paper stacked on the output tray 11) using the amount of the change in the angle. Accordingly, the pendulum device 3 and the counter 33 may correspond to a "measuring device" in the present invention. The counter 33 may be comprised in a control device 80, which is described below.

Figure 5:
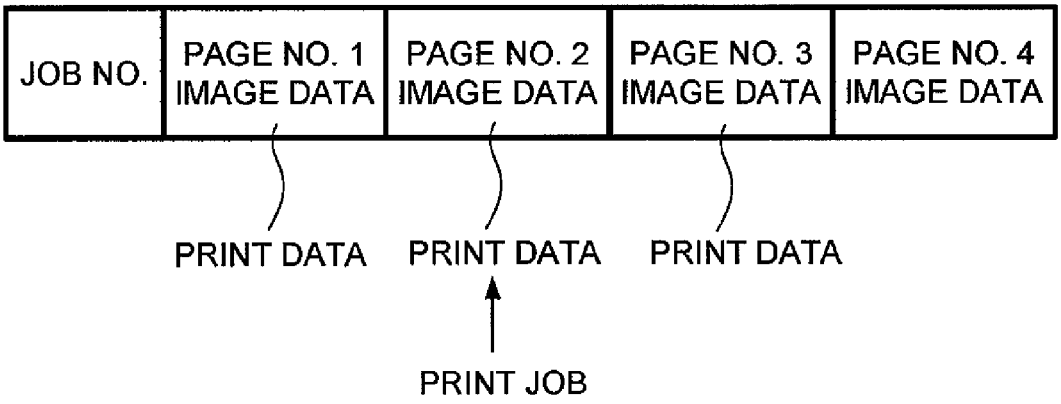
FIG. 5 is a diagrammatic view that shows a data structure in an exemplary format for a print job.

FIG. 5 shows an exemplary format for a print job. The print job may comprise a job number and print data subsequent thereto. The print data may comprise the page number of an image to be printed and image data corresponding to the image to be printed on the respective page. When the print job comprises a plurality of sheets of print data, the sheets of print data may be arranged in the printing order shown in FIG. 5 (e.g., from the left to the right of the print job) or in another order.

The image data may comprise a flag, which may indicate of whether an image is to be printed using black and white printing or color printing, and vector image data, which may provide a reference for calculating the size and quantity of ink droplets to be ejected to a pixel region on the sheet of paper P, and other data. A plurality of print jobs may be sequentially input into a parameter determining device 81.

Figure 6:
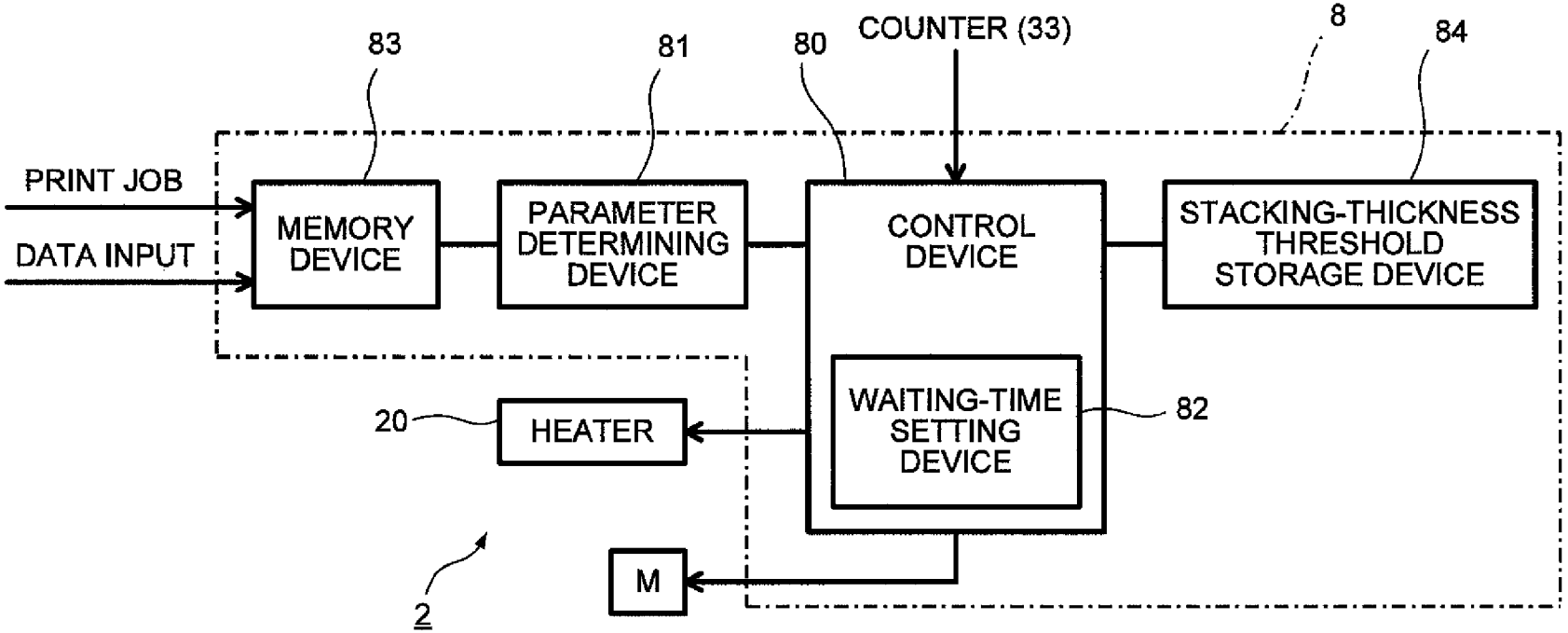
FIG. 6 is a diagrammatic view that shows a schematic illustration of an internal configuration of a controller.

FIG. 6 shows a schematic representation of an internal configuration of the controller 8. The controller 8 may comprise a central processing unit ("CPU") 91, a read-only memory ("ROM") 93 that stores computer-readable instructions executable by the CPU 91 and data for use while executing the computer-readable instructions and that allows the data to be rewritable, a random-access memory ("RAM") 92 that stores data temporarily during the execution of the computer-readable instructions, and a non-volatile memory, all of which are not shown. For example, other computer-readable media may be substituted for the ROM 93. When executing the computer-readable instructions therein, the controller 8 may function as a memory device 83, the parameter determining device 81, the control device 80, and a stacking-thickness threshold storage device 84. The memory device 83 may receive the above-described print job and data input through the operation panel 12. The memory device 83 may be connected to the parameter determining device 81. The parameter determining device 81 may be connected to the control device 80. The control device 80 may be connected to the stacking-thickness threshold storage device 84. The stacking-thickness threshold storage device 84 may store the threshold of the stacking thickness of the sheets of paper P discharged to one or more of the output tray 11 and the face-up output tray 15. The memory device 83 may comprise the RAM 92. The stacking-thickness threshold storage device 84 may comprise the ROM 93. The parameter determining device 81 and the control device 80 may comprise the CPU 91 executing the computer-readable instructions therein.

The control device 80 may comprise a waiting-time setting device 82 that may set a waiting time in the motor M. Accordingly, in an exemplary configuration, the controller 8 shown in FIG. 6 may use a waiting time as the curl correcting amount.

The parameter determining device 81 may read one or more of a parameter comprised in a print job and input data, and the parameter determining device 81 may determine the content of the parameter therefrom. The control device 80 may control an ejecting operation of the liquid ejection head 4 and may cause the waiting-time setting device 82 to set a waiting time based on the content of the parameter determined by the parameter determining device 81.

When the value of the stacking thickness of printed paper P stacked on the output tray 11 is low (e.g., a value corresponding to 1 or 2 sheets of paper P), the vertical distance between the uppermost paper P and the output port 14 (L1 in FIG. 1) may be great. Accordingly, even when a slight curl remains in the sheet of paper P discharged through the output port 14, the possibility that the sheet of paper P may collide with the uppermost paper P on the output tray 11 may be low. Thus the degree of correction of the curl of the sheet of paper P discharged to the output tray 11 may be small.

In contrast, when many sheets of paper P are stacked on the output tray 11 (e.g., an entire ream of paper P), the value of the stacking thickness of printed paper P stacked on the output tray 11 may be large, and the sheet of paper P in the uppermost position and the output port 14 may be may be disposed near to each other. Accordingly, even when the curl amount of the uppermost paper P is low, the possibility that a subsequently discharged sheet of paper P may collide with the uppermost paper P on the output tray 11 may be high, and the sheet of paper P may be damaged (e.g., bent, warped). To reduce the likelihood of such a situation, when the stacking thickness of paper P discharged to the output tray 11 is greater than or equal to a predetermined value (e.g., a threshold stacking thickness), the waiting time for the sheet of paper P may be increased, which may increase the degree of correction of a curl.

In an exemplary configuration, the threshold stacking thickness of paper P stored in the stacking-thickness threshold storage device 84 may be 5 cm. The waiting-time setting device 82 may comprise a table T0 in which the values of the stacking thickness of paper P on the output tray 11 and the values of the waiting time according to the stacking thickness may be stored. FIG. 7 shows the table T0. In the table T0, after the stacking thickness becomes greater than or equal to 5 cm, which may be the threshold stacking thickness in the stacking-thickness threshold storage device 84, the value of the waiting time may increase with an increase in the stacking thickness. In this exemplary configuration, the printing conditions (e.g., image printed on the sheet of paper P, the amount of ink or the amount of process liquid ejected toward the sheet of paper P) may be the same.

In the table T0, when the stacking thickness is less than 5 cm, which may be the threshold in the stacking-thickness threshold storage device 84, the value of the waiting time may be set at a certain time T (e.g., 0.5 seconds). The value of the certain time T may be less than the value of the waiting time for a stacking thickness of 5 cm, which may be the threshold stacking thickness of paper P. The values of the waiting time and the stacking thickness in FIG. 7 are merely for illustrative purposes and are not intended to limit the scope of the invention.

Figure 8:
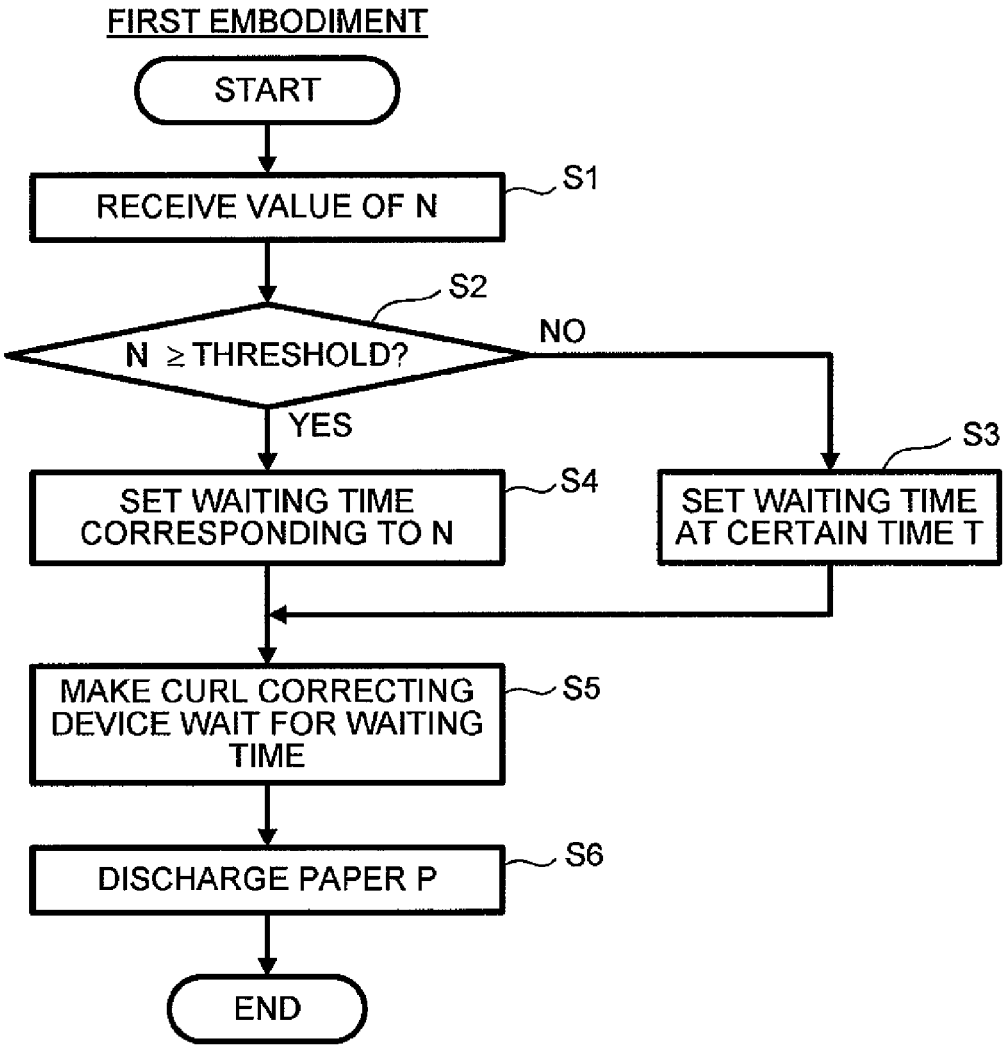
FIG. 8 is a flow sheet that shows operations of the controller according to particular configurations.

A specific operation of the controller 8 is described below with reference to the flowchart of FIG. 8.

When a print job is input through the memory device 83 into the parameter determining device 81, the control device 80 may start measuring the stacking thickness of paper P stacked on the output tray 11.

When the value of the stacking thickness N of paper P stacked on the output tray 11 is input from the counter 33 (step S1), the control device 80 may read the threshold from the stacking-thickness threshold storage device 84. Subsequently, the control device 80 may determine whether the value of the stacking thickness N of paper P is greater than or equal to the threshold stacking distance (step S2). When it is determined that the value of the stacking thickness of paper P is less than the threshold, the control device 80 may notify the waiting-time setting device 82 about this determination, and the waiting-time setting device 82 may set the waiting time at a certain time T (e.g., a second processing level) (step S3). The waiting-time setting device 82 causes the curl correcting device 2 to wait for the certain time T (step S5). Specifically, after the control device 80 detects the completion of discharging ink through the liquid ejection head 4 to paper P relating to print data, the waiting-time setting device 82 stops the rotation of the motor M for the certain time T so as to stop the sheet of paper P to which the ink has been ejected at a predetermined position of the guide 52.

When it is determined in step S2 that the value of the stacking thickness N is greater than or equal to the threshold, the control device 80 may notify the waiting-time setting device 82 about this determination, and the waiting-time setting device 82 may set the waiting time corresponding to the value of the stacking thickness N (step S4). The waiting-time setting device 82 may read the waiting time corresponding to the value of the stacking thickness N of paper P from the table T0 stored therein (e.g., a first processing level) and may make the curl correcting device 2 wait for the waiting time (step S5). Under these conditions, as the value of the stacking thickness N of paper P increases, the waiting time may increase in stages.

After the elapse of the waiting time, the waiting-time setting device 82 may cause the motor M to rotate again, and the printed paper P, in which the curl has been corrected, may be discharged to the output tray 11 (step S6).

Here, a situation is described in which the uppermost paper P collides with the next discharged paper P and the sheet of paper P may suffer from a defect, such as bending or warping, when many sheets of paper P are stacked on the output tray 11 and the uppermost paper P and the output port 14 are disposed near each other. The sheet of paper P may be discharged to the output tray 11 such that the surface with the ink ejected thereon may be face-down. When the paper P has not been subjected to enough curl correction and is discharged to the output tray 11, the sheet of paper P may be curled such that an edge of the sheet of paper P may be bent upward in the stacking direction of paper P. When many sheets of paper P are stacked on the output tray 11 and the sheet of paper P in the uppermost position and the output port 14 may be close to each other, the curled edge of the sheet of paper P may block partly the output port 14 (e.g., an edge of the sheet of paper P may cover part of the output port 14). Thus, even when the amount of paper P stacked on the output tray 11 does not reach an upper limit of paper stacked on the output tray 11 (e.g., a maximum capacity of the output tray 11), a sheet of paper P discharged through the output port 14 may collide with the edge of the sheet of paper P partly blocking the output port 14, and the sheet of paper P partly blocking the output port 14 may suffer from a defect, such as bending or warping.

Paper P stacked on the face-up output tray 15 may comprise sheets of paper with the surface with ink ejected thereon stacked face-up thereon. When the paper P has not been subjected to enough curl correction and is discharged to the face-up output tray 15, the sheet of paper P may be curled such that its central part may be bent upward in the stacking direction (e.g., the vertical direction). When many sheets of paper P are stacked on the face-up output tray 15 and the sheet of paper P in the uppermost position and the opening 16 may be close to each other, an edge of the curled sheet of paper P may partly block the opening 16 (e.g., edge of the sheet of paper P covers part of the opening 16) when the grain of the sheet of paper P is parallel to the sub-scanning direction. Thus, even when the amount of paper P stacked on the face-up output tray 15 does not reach an upper limit of paper stacked on the face-up output tray 15 (e.g., a maximum capacity of the face-up output tray 15), a sheet of paper P discharged through the opening 16 may collide with the edge of the sheet of paper P partly blocking the opening 16, and the sheet of paper P partly blocking the output port 14 may suffer from a defect, such as bending or warping. When the grain of the sheet of paper P is parallel to the main scanning direction, the possibility that the edge of the curled paper P partly blocks the opening 16 may be low, but the sheet of paper P stacked on the face-up output tray 15 may be curled such that its central part may be bowed upward. A sheet of paper P discharged through the opening 16 may be pushed up by the upwardly bowed portion, may fall outside the face-up output tray 15, and may suffer from a defect, such as bending, warping, or soiling.

In the ink jet recording apparatus 1 described above, when the value of the stacking thickness N of paper P stacked in an output tray 11 or 15 is greater than or equal to the threshold stacking thickness, the waiting time of paper P may be made long and the curl may be sufficiently corrected. Therefore, when many sheets of paper P are stacked on the output tray 11 and when the sheet of paper P in the uppermost position and the output port 14 are disposed near to each other, the edge of the curled paper P may not partly block the output port 14. Accordingly, the possibility that the uppermost sheet of paper P among the sheets of paper P stacked on the output tray 11 and a sheet of paper P subsequently discharged to the output tray 11 may collide with each other may be reduced. When the value of the stacking thickness N of paper P stacked in one or more of the output tray 11 and the face-up output tray 15 is less than the threshold stacking thickness, a sheet of paper P comprising a curl may be pressed by the weight of subsequent paper P discharged to the one or more of the output tray 11 and the face-up output tray 15 for a period of time that is greater than a waiting time when the value of the stacking thickness N is greater than or equal to the threshold stacking time.

Consequently, the curl may be corrected by the weight of subsequent paper P discharged to the one or more of the output tray 11 and the face-up output tray 15. Consequently, the influence of the curl on the sheet of paper P in the uppermost position on the one or more of the output tray 11 and the face-up output tray 15 may be reduced. When the value of the stacking thickness N of paper P stacked in one or more of the output tray 11 and the face-up output tray 15 remains less than the threshold stacking thickness, a total throughput time may also be reduced because an initial waiting time may be less than that after the value of the stacking thickness N of paper P stacked becomes greater than or equal to the threshold. The total throughput time may be a total time from the start of image formation to the end of discharging all corresponding recording media with the images recorded thereon to the one or more of the output tray 11 and the face-up output tray 15.

In the ink jet recording apparatus 1 according to the above-described configurations, the waiting time may be changed depending on whether the value of the stacking thickness of paper P stacked on the one or more of the output tray 11 and the face-up output tray 15 is greater than or equal to the threshold stacking thickness. Alternatively or additionally, the waiting time may be changed based on the distance L1 (shown in FIG. 1) between the output port 14 and the uppermost paper P stacked on the output tray 11. Accordingly, when the number of sheets of paper P stacked on the one or more of the output tray 11 and the face-up output tray 15 is small, the distance L1 is great, and the likelihood that a discharged sheet of paper P may collide with the stacked paper P may be reduced, even when the curl amount of discharged paper P is great.

In contrast, when the number of sheets of paper P stacked on the output tray 11 is great, the distance L1 is reduced, and increasing the waiting time may reduce the likelihood that a discharged sheet of paper P may collide with the stacked paper P. The distance L1 may be determined by subtracting the value of the stacking thickness N from the distance L between the upper end of the vertical wall 11*a* and a lowermost portion of an upper surface of the bottom board 11*b*. Alternatively, a distance corresponding to the distance L1 may be determined for the face-up output tray 15 by subtracting the value of the stacking thickness N on the face-up output tray 15 from a distance L between the upper end of the face-up output tray 15 adjacent to casing 10 and a lowermost portion of an upper surface of the medium-placed face 15*a* when the face-up output tray 15 is in the open state.

The value of the distance L may be stored in, for example, the control device 80. The control device 80 may perform substantially the same operation as the operations described above to calculate the distance L1 based on the distance L and the value of the stacking thickness N.

Printed paper P discharged through the output port 14 may fall from the output port 14 to the output tray 11 over a fall time. Ink on the sheet of paper P may dry during the fall time. When the distance L1 between the output port 14 and the uppermost sheet of paper P is reduced, the fall time may be reduced, which may reduce a drying time. Accordingly, the control device 80 may change the waiting time of paper P to sufficiently correct the curl by utilizing the fall time to determine a sufficient degree of correction of the curl.

As previously described, face-up printing and face-down printing may be selectively switched by an input to the operation panel 12 or, alternatively, by an input from a connected computer. During face-up printing, each sheet of paper P may be curled and bowed upward; however, the curl may be corrected by the weight of other sheets of paper P stacked thereon. In contrast, during face-down printing, each sheet of paper P may be curled and bowed downward, such that it may be difficult to correct the curl with the weight of other sheets of paper P stacked thereon. Accordingly, the degree of correction of a curl used in face-down printing may be greater than the degree of correction of a curl used in face-up printing. Consequently, the waiting time for a sheet of paper P during face-down printing may be greater than the waiting time for a similarly-disposed sheet of paper P during face-up printing.

Figure 10:
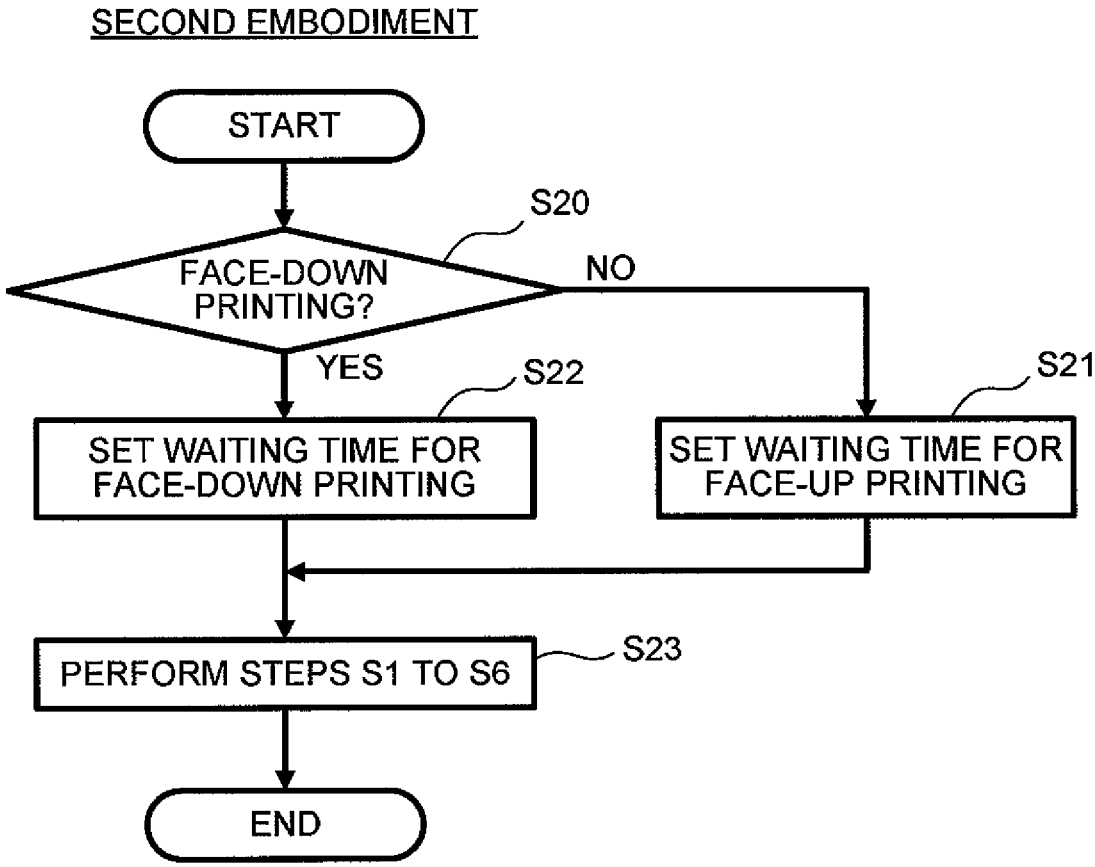
FIG. 10 is a flow sheet that shows operations of the controller according to the certain configurations of FIG. 9.

The waiting-time setting device 82 may comprise a first table T1, in which the values of the waiting time for face-up printing may be stored according to the values of the stacking thickness of paper P, and a second table T2, in which the values of the waiting time for face-down printing may be stored according to the values of the stacking thickness of paper P, as shown in FIG. 9. In the case of face-down printing, a waiting time may be greater than the waiting time in face-up printing for the same stacking thickness due to the difference in the above-described defects. Consequently, the values of the waiting time in the second table T2 may be greater than the values of the waiting time in the first table T1. The values of the waiting time in the tables shown in FIG. 9 are merely for illustrative purposes and are not intended to limit the invention thereto. An operation of the controller 8 using the first table T1 and the second table T2 is described below with reference to the flowchart of FIG. 10.

The parameter determining device 81 may determine whether face-down printing or face-up printing is to be performed from information input through the operation panel 12 (step S20). The determination may be transmitted to the control device 80.

When it is determined in step S20 that the face-up printing is to be performed, the control device 80 may notify the waiting-time setting device 82 of this determination. The waiting-time setting device 82 may set the waiting time corresponding to face-up printing in the curl correcting device 2. The waiting-time setting device 82 may read the corresponding waiting time from the first table T1 and may set the waiting time for the motor M to be less than the waiting time for the motor M that may be used in face-down printing with a corresponding stacking thickness (step S21).

When it is determined in step S20 that the face-down printing is to be performed, the control device 80 may notify the waiting-time setting device 82 of this determination. The waiting-time setting device 82 may set the waiting time corresponding to the face-down printing in the curl correcting device 2. The waiting-time setting device 82 may read the corresponding waiting time from the second table T2 and may set the waiting time for the motor M to be greater than the waiting time for the motor M that may be used in face-up printing with a corresponding stacking thickness (step S22).

Thereafter, the control device 80 and the waiting-time setting device 82 may perform the process of steps S1 to S6 described above (shown as step S23 in FIG. 10). Accordingly, the waiting time may be read from at least one of the first table T1 and the second table T2 according to the stacking thickness of paper P, and the curl correcting device 2 may wait for the waiting time read from the at least one of the first table and the second table.

The face-down printing may require a greater amount of time to correct a curl of paper P than the amount of time to correct a curl of paper P in the face-up printing. Accordingly, a greater waiting time may be set as the waiting time for face-down printing to increase the degree of correction of a curl.

As described above, image data in a print job may comprise vector image data that may comprise a reference for calculating a size and a quantity of ink droplets to be ejected to a pixel region on a sheet of paper P. Converting the vector image data into raster image data may generate data for ink ejection. FIGS. 11A-11D show exemplary data for ink ejection corresponding to the ink colors of black, cyan, magenta, and yellow, respectively, according to further configurations. The data for ink ejection may indicate at least one of a size and a quantity of ink droplets to be ejected in each block (e.g., each specified pixel region) specified on a sheet of paper P. In FIGS. 11A-11D, the size of ink droplets may be represented in the following exemplary manner: large droplets may be indicated by L, medium droplets may be indicated by M, and small droplets may be indicated by S.

An entire amount of ink to be ejected on a sheet of paper P may be determined by adding the sizes and quantities of ink droplets of each color to be ejected for each block (e.g., each pixel region) shown in FIGS. 11A-11D together and summing the sizes and quantities of ink droplets for all of the blocks (e.g., all of the pixel regions). When the amount of ink to be ejected is great, it may be desirable to let the ink dry sufficiently to correct the curl amount. In contrast, when the amount of ink ejected is small, the ink may dry quickly.

In the ink jet recording apparatus according to the further configurations of FIGS. 11A-11D, it may be determined initially whether the amount of ink to be ejected toward a sheet of paper P is, for example, large, small, or medium. Accordingly, in the further configurations of FIGS. 11A-11D, a parameter to be determined by the parameter determining device 81 may be the amount of ink to be ejected to a sheet of paper P.

In certain configurations, the waiting time may be set based on a value comprising both the amount of process liquid to be ejected through the process-liquid head 4*a* and the amount of ink to be ejected through all of the liquid ejection heads 4.

The waiting-time setting device 82 may comprise a third table, in which the values of the waiting time when the amount of ink to be ejected to the sheet of paper P is small may be stored according to the values of the stacking thickness, and a fourth table, in which the values of the waiting time when the amount of ink to be ejected toward paper P is great may be stored according to the values of the stacking thickness. The configuration of each of the third and fourth tables may be substantially the same as the first and second tables T1 and T2 shown in FIG. 9, except that the third and fourth tables may correspond to an amount of ink to be ejected toward a sheet of paper P rather than a type of printing (e.g., face-up printing or face-down printing) as described above.

Figure 12:
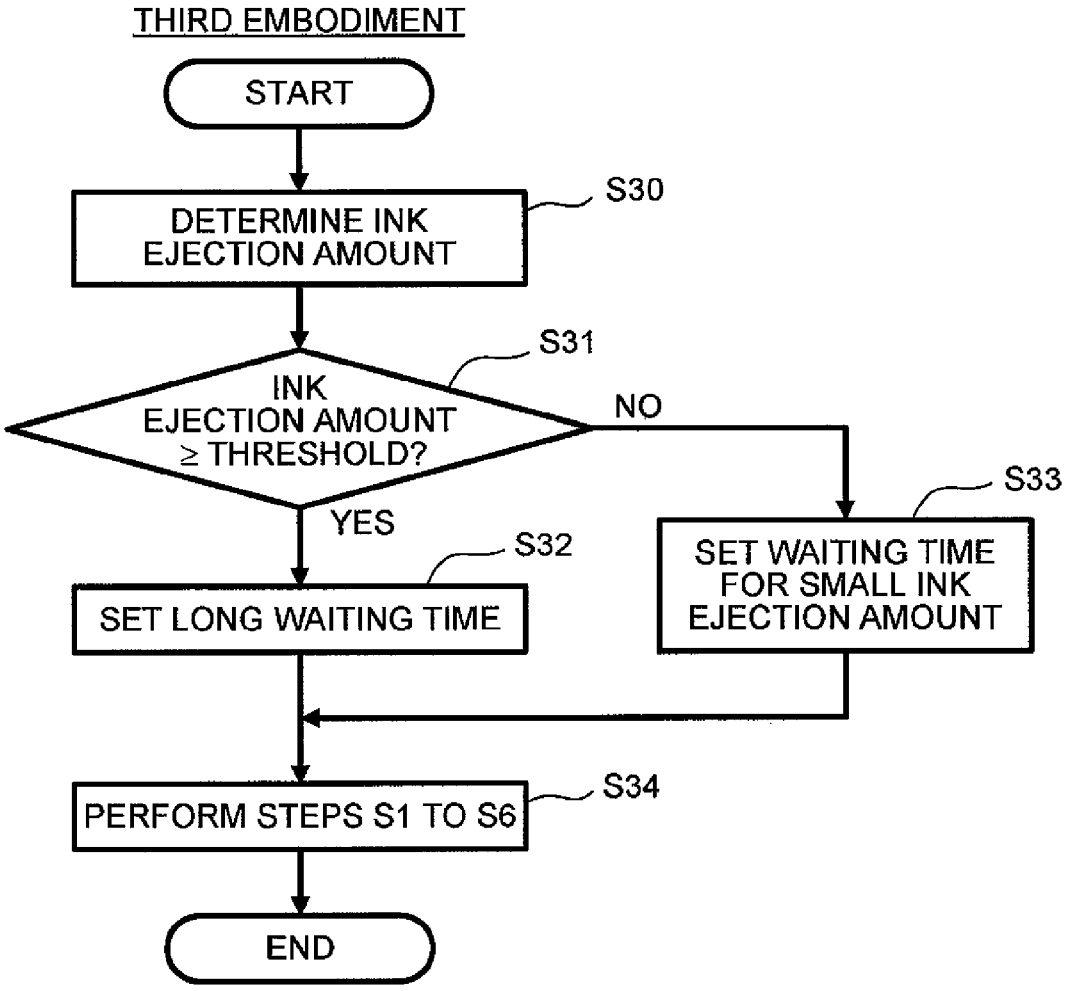
FIG. 12 is a flow sheet that shows operations of the controller according to the further configurations of FIGS. 11A-11D.

When the amount of ink to be ejected to a sheet of paper P is great, the waiting time may be greater than the waiting time when the amount of ink to be ejected to paper P is small and the stacking thickness is the same. Accordingly, for the same stacking thickness, the values of the waiting time in the fourth table may be greater than the values of the waiting time in the third table. An operation of the controller 8 according to the further configurations of FIGS. 11A-11D is described below with reference to the flowchart of FIG. 12.

An ink ejection data generating device (not shown), which may generate data for ink ejection by converting vector image data for a print job into raster image data, may be disposed on an input side of the parameter determining device 81. The print job from the memory device 83 may be input into the ink ejection data generating device, and the vector image data may be converted into the raster image data.

The raster image data may be input into the parameter determining device 81, and the parameter determining device 81 may determine the amount of ink to be ejected to paper P from the raster image data (step S30). The amount of ink to be ejected may be obtained by calculating the amount of ink to be ejected in each block and summing the amount of ink to be ejected over all of the blocks. In particular, the number of ink droplets of each size to be ejected in a block may be multiplied by the corresponding amount of ink in droplets of each size to determine the amount of ink to be ejected in each block. Data comprising the amount of ink to be ejected may be transmitted to the control device 80. The control device 80 may store a threshold value for the amount of ink to be ejected (e.g., a threshold ink ejection amount). The control device 80 may determine whether the amount of ink to be ejected to paper P is greater than or equal to the threshold ink ejection amount (step S31). Accordingly, in the present configuration, the control device 80 may correspond to a "liquid ejection amount determining device."

When it is determined in step S31 that the amount of ink to be ejected toward a sheet of paper P is greater than or equal to the threshold ink ejection amount, the control device 80 may notify the waiting-time setting device 82 of this determination. When the amount of ink to be ejected is greater than or equal to the threshold ink ejection amount, the waiting-time setting device 82 may set the waiting time in the curl correcting device 2 to be greater than the waiting time when the amount of ink to be ejected is less than the threshold ink ejection amount and the stacking distance is the same (step S32). In particular, the waiting-time setting device 82 may read the value of the corresponding waiting time from the fourth table and may set the read value as the waiting time in the curl correcting device 2.

When it is determined in step S31 that the amount of ink to be ejected toward paper P is less than the threshold ink ejection amount, the control device 80 may notify the waiting-time setting device 82 of this determination. When the amount of ink to be ejected is less than the threshold ink ejection amount, the waiting-time setting device 82 may set the waiting time in the curl correcting device 2 to be less than the waiting time when the amount of ink to be ejected is greater than or equal to the threshold ink ejection amount and the stacking distance is the same (step S33). Accordingly, the waiting-time setting device 82 may read the value of the corresponding waiting time from the third table and may set the read value as the waiting time in the curl correcting device 2. Thereafter, the process of steps S1 to S6 may be performed (shown as step S34 in FIG. 12). Accordingly, the corresponding waiting time may be read from at least one of the third table and the fourth table, depending on the value of the stacking thickness, and the curl correcting device 2 may wait for the waiting time from the at least one of the third table and the fourth table.

It may take a great amount of time to correct the curl of the sheet of paper P when the amount of ink to be ejected to paper P is great. Accordingly, a longer waiting time may be set to sufficiently correct the curl.

In the present configuration, the control device 80 may compare the amount of ink to be ejected toward a sheet of paper P against the threshold ink ejection amount. Alternatively, another configuration may be implemented. The control device 80 initially may calculate the area in which the ink is to be attached for each block, sum the areas where the ink is to be attached over all of the blocks, and calculate the area in which the ink is to be attached to the sheet of paper P. The control device 80 may access a threshold corresponding to an area in which the ink is to be attached (e.g., a threshold ink attachment area) and may compare the area in which the ink is to be attached with the threshold ink attachment area.

Even when the entire amount of ink ejected toward the paper P may be similar, a curl amount may vary based on a distribution of the ink ejected toward a sheet of paper P. For example, a curl amount of a sheet of paper P, in which the amount of ink ejected to the edges of the sheet of paper P is great and the amount of ink ejected to the central portion of the sheet of paper P is small, and a curl amount of a sheet of paper P, in which the amount of ink ejected to the edges of the sheet of paper P is small and the amount of ink ejected to the central portion of the sheet of paper P is great, may be different. When a great amount of ink is ejected toward the edges of a sheet of paper P, the curl amount may be great, and the waiting time to sufficiently correct the curl may be greater than the waiting time to sufficiently correct the curl when a small amount of ink is ejected toward the edges of a sheet of paper P. Accordingly, the waiting-time setting device 82 may set at least one of an estimated value of the waiting time based on the entire amount of ink to be ejected toward the sheet of paper P and a final value of the waiting time based on a distribution of ink to be ejected toward the sheet of paper P (e.g., an amount of ink to be ejected based on a location in a block or a pixel region on the sheet of paper P).

As described above, when the amount of ink ejected to a sheet of paper P is great, the curl amount of the sheet of paper P may be great, and a time to correct the curl while letting the ink dry may be greater than when the amount of ink ejected to a sheet of paper P is small. In contrast, when the amount of ink ejected to paper P is small, the curl amount of the sheet of paper P may be small, and a time to correct the curl while letting the ink dry may be less than when the amount of ink ejected to a sheet of paper P is great. Even when the entire amount of ink to be ejected toward the entire sheet of paper P is the same (e.g., a uniform distribution of ink), the curl amount when a great amount of ink is to be ejected toward the edges of the sheet of paper P may be greater than the curl amount when a great amount of ink is to be ejected toward the central portion of the sheet of paper P.

As described above, the amount of ink to be ejected toward the sheet of paper P for each block may be determined from data for ink ejection generated from vector image data comprised in print data. The curl amount of the sheet of paper P may be determined from the position and the amount of ink to be ejected in each block based on an empirical rule. Consequently, the curl amount may be reduced effectively by calculating the curl amount of the sheet of paper P when ink is to be ejected thereon and setting the curl correcting amount, such as the waiting time, in the curl correcting device 2 according to the curl amount.

In the present configurations, when the stacking thickness of paper P is greater than or equal to a predetermined thickness and the curl amount is greater than or equal to a predetermined threshold curl amount, the degree of correction of a curl may be further increased.

Figure 13:
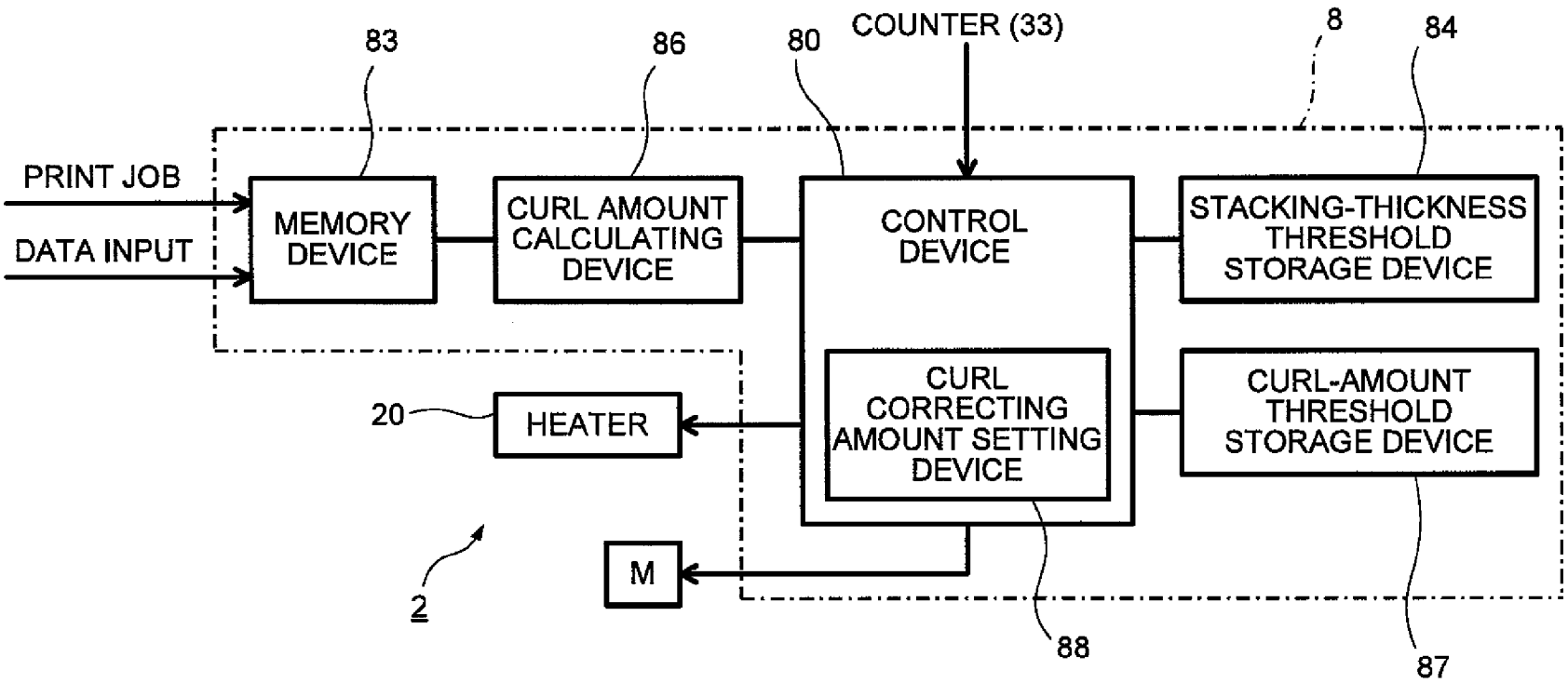
FIG. 13 is a diagrammatic view that shows a schematic illustration of an internal configuration of a controller according to other configurations.

FIG. 13 is a schematic representation of the controller 8 according to other configurations. The controller 8 may comprise the memory device 83, a curl amount calculating device 86, the control device 80, the stacking-thickness threshold storage device 84, and a curl-amount threshold storage device 87. The memory device 83 may receive a print job. The curl amount calculating device 86 may calculate the curl amount of paper P when ink is to be ejected thereon based on image data in the print job, as described above. The curl amount calculating device 86 may be connected to the control device 80. The control device 80 may be connected to the stacking-thickness threshold storage device 84. The stacking-thickness threshold storage device 84 may store the threshold stacking thickness corresponding to the output tray 11. The curl-amount threshold storage device 87 stores the threshold curl amount of a sheet of paper P and may be connected to the control device 80.

The control device 80 may comprise a curl correcting amount setting device 88 that may set the curl correcting amount in each of the motor M and the heater 20. The controller 8 shown in FIG. 13 may, for example, use the waiting time as the curl correcting amount.

The curl-amount threshold storage device 87 may comprise at least two threshold values: a first curl threshold amount and a second curl threshold amount, which is less than the first threshold curl amount. In an exemplary configuration, the first threshold curl amount may be 2 cm and the second threshold curl amount may be 1 cm as described below (see FIG. 14). In such an exemplary configuration, the threshold stacking thickness stored in the stacking-thickness threshold storage device 84 may be 5 cm.

As shown in FIG. 14, the curl correcting amount setting device 88 may comprise a table T3 in which values of the stacking thickness of paper P on the output tray 11 and the values of the first and second waiting time corresponding to each stacking thickness may be stored. The relationship between the stacking thickness of paper P and the first waiting time may be substantially the same as the relationship between the stacking thickness of paper P and the waiting time in the table T0, as shown in FIG. 7. When the stacking thickness is less than the threshold 5 cm, the value of the waiting time may be set at a certain time T (e.g., 0.5 seconds). For the same stacking thickness, the second waiting time may be greater than the first waiting time, and the second waiting time may be a time sufficient to correct the curl amount of the sheet of paper P to an amount less than the threshold curl amount stored in the curl-amount threshold storage device 87. In the table T3, when the stacking thickness is greater than or equal to the threshold 5 cm in the stacking-thickness threshold storage device 84, the value of each of the first and second waiting times may increase with an increase in the stacking thickness. The values of the first and second waiting times and the stacking thickness in FIG. 14 are merely for illustrative purposes and are not intended to limit the scope of the invention.

Figure 15:
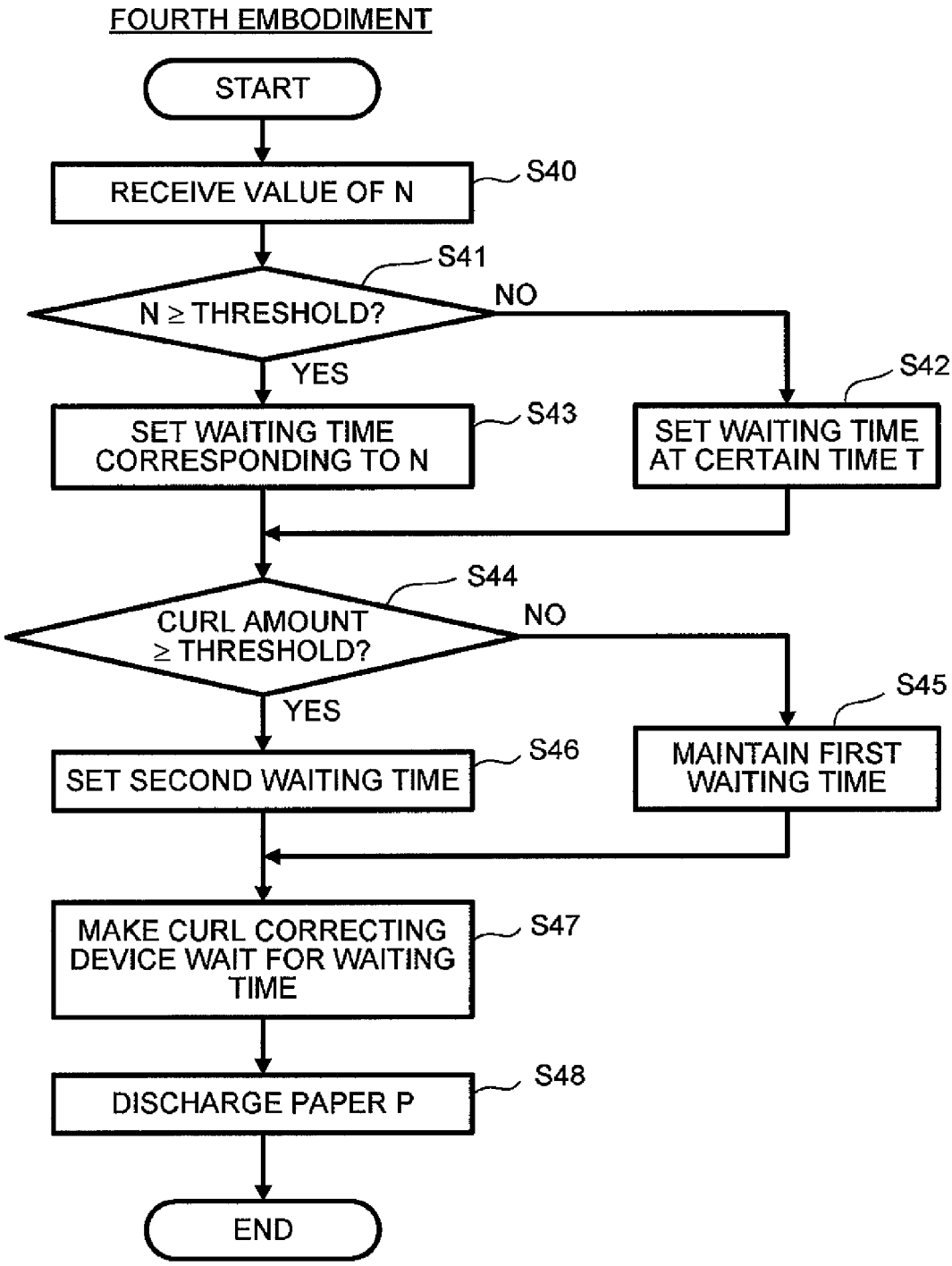
FIG. 15 is a flow sheet that shows operations of the controller according to the other configurations of FIG. 13.

A specific operation of the controller 8 according to the present configurations is described below with reference to the flowchart of FIG. 15.

When a print job is input through the memory device 83 into the curl amount calculating device 86, the control device 80 may determine that a process of stacking paper P on the output tray 11 is to begin. The curl amount calculating device 86 may calculate the curl amount of a sheet of paper P from image data in the print job when ink is to be ejected thereon, and the curl amount calculating device 86 may output the result of the calculation to the control device 80.

When the value of the stacking thickness N of paper P stacked on the output tray 11 is input from the counter 33 (step S40), the control device 80 may read the threshold stacking thickness from the stacking-thickness threshold storage device 84. Subsequently, the control device 80 may determine whether the value of the stacking thickness N of paper P is greater than or equal to the threshold stacking thickness (step S41). When it is determined that the value of the stacking thickness of paper P is less than the threshold stacking thickness, the control device 80 may notify the curl correcting amount setting device 88 of this determination, and the curl correcting amount setting device 88 may set the waiting time as the certain time T as the first waiting time (step S42).

When it is determined in step S41 that the value of the stacking thickness N of paper P is greater than or equal to the threshold stacking thickness, the control device 80 may notify the curl correcting amount setting device 88 of this determination, and the curl correcting amount setting device 88 may set temporarily the waiting time to a time that corresponds to the value of the stacking thickness N in the first waiting time (step S43). For example, when the stacking thickness is 6 cm, the waiting time may be temporarily set at 0.8 seconds, as shown in the table T3 in FIG. 14. The waiting time may increase in stages as the value of the stacking thickness N of paper P increases.

Subsequently, the control device 80 may compare the result of the calculation of the curl amount of paper P input from the curl amount calculating device 86 with the threshold curl amount corresponding to the value of the stacking thickness in the curl-amount threshold storage device 87 (step S44). When it is determined that the result of the calculation of the curl amount is less than the threshold curl amount, the value of the first waiting time determined in at least one of step S42 and S43 may be maintained (step S45).

When it is determined in step S44 that the result of the calculation of the curl amount is greater than or equal to the threshold curl amount, the control device 80 may notify the curl correcting amount setting device 88 of this determination. The curl correcting amount setting device 88 may reset the waiting time to the time corresponding to the value of the stacking thickness N of paper P corresponding to the second waiting time (step S46). For example, when the stacking thickness is 6 cm, the waiting time may be reset to 1.0 second, as shown in the table T3 in FIG. 14.

Thereafter, the curl correcting amount setting device 88 may make the curl correcting device 2 wait for the appropriate one of the first waiting time and the second waiting time set in the curl correcting device 2 (step S47). In particular, when the control device 80 detects the completion of ink ejection through the liquid ejection head 4 to a sheet of paper P relating to print data, the curl correcting amount setting device 88 may stop the rotation of the motor M for the set waiting time.

After the lapse of the set waiting time, the curl correcting amount setting device 88 may rotate the motor M again, and the printed paper P in which the curl may be sufficiently corrected may be ejected to the output tray 11 (step S48).

In the present configurations, the likelihood that the uppermost sheet of paper P stacked in the output tray 11 and a subsequently ejected sheet of paper P may collide with each other may be further reduced by correction of the curl based on the curl amount of the sheet of paper P and the value of the stacking thickness N of paper P.

When the curl amount of a sheet of paper P calculated by the curl amount calculating device 86 is less than the second threshold curl amount, the curl amount may be considered to be zero, and the process of steps S44, S45, and S46 may be omitted.

Figure 16A:
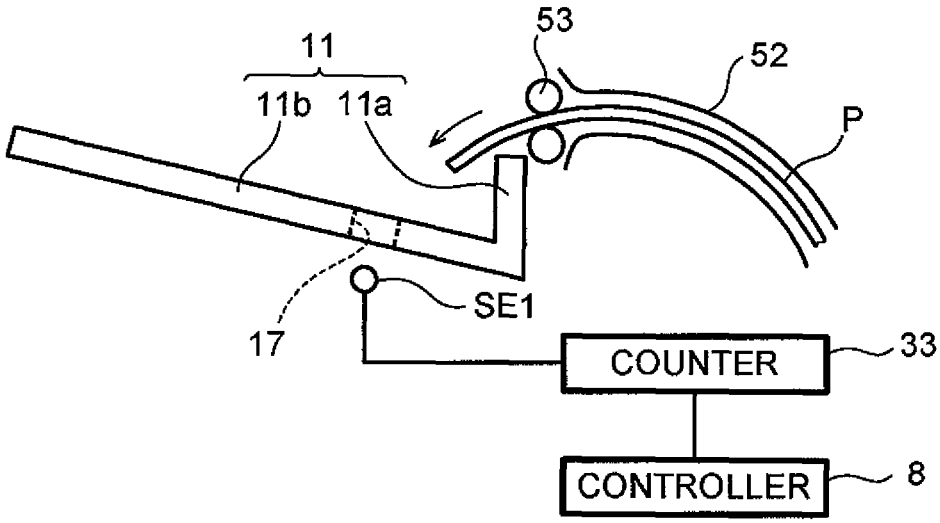
FIG. 16A is a side view that shows a schematic illustration of an output tray and a measuring device with an optical sensor.

In another configuration of the "measuring device," the measuring device may be disposed near the output tray 11. As shown in FIG. 16A, the bottom board 11*b* in the output tray 11 may form a light-passing hole 17, and an optical sensor SE1 configured to emit light upward may be arranged below the light-passing hole 17. The optical sensor SE1 may be connected to the counter 33, and the counter 33 may be connected to the controller 8. Consequently, the controller 8 may identify when a process of ejecting ink to a sheet of paper P is completed in addition to controlling an operation of the liquid ejection head 4. When a sheet of paper P is not being discharged to the output tray 11, light from the optical sensor SE1 may pass through the light-passing hole 17 without being reflected by the paper P, and the light may not enter the optical sensor SE1. When a sheet of paper P is discharged to the output tray 11, light from the optical sensor SE1 may pass through the light-passing hole 17, the light may be reflected by the sheet of paper P, and the light may enter the optical sensor SE1. When detecting the entering light, the optical sensor SE1 may output information indicating this detection to the counter 33. The counter 33 may determine a stacking thickness of the paper P on the output tray 11 from this information. Subsequently, the counter 33 may obtain information, which may indicate that ink has been ejected to the sheet of paper P, from the controller 8, and the counter 33 may count the number of sheets of paper P discharged to the output tray 11. The counter 33 may comprise information about the thickness of a single sheet of paper P and may calculate the stacking thickness of paper P by multiplying the thickness of the single sheet of paper P by the number of sheets of paper P.

Figure 16B:
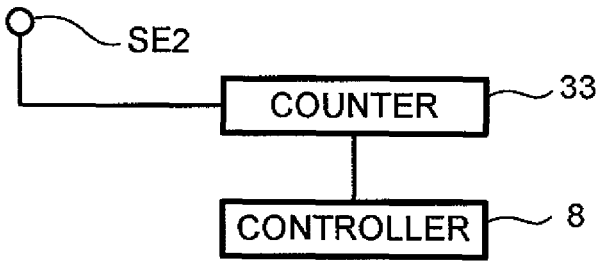
FIG. 16B is a diagrammatic view that shows further configurations of a measuring device with a paper passage sensor.

In yet another configuration, the "measuring device" may comprise a paper passage sensor SE2, which may be disposed upstream of the liquid ejection head 4. Passage sensor SE2 may be connected to the counter 33, as shown in FIGS. 1 and 16B. When a signal is output to the counter 33 each time the sheet of paper passage sensor SE2 detects that a single sheet of paper P has passed by, the number of sheets of paper P discharged to the output tray 11 may be counted. The stacking thickness of paper P may be obtained by multiplying the thickness of the single sheet of paper P by the number of sheets of paper P.

Figure 17A:
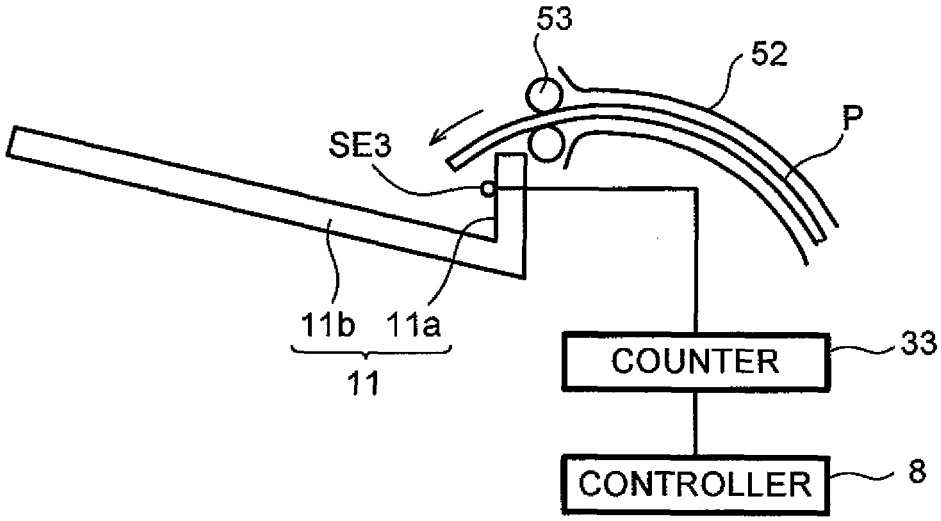
FIG. 17A is a side view that shows a schematic illustration of an output tray and a measuring device with a height position detecting sensor.

In still yet another configuration, the "measuring device" may comprise a height position detecting sensor SE3, which may be disposed on the inner portion of the vertical wall 11*a* of the output tray 11. The height position detecting sensor SE3 may be connected to the counter 33, as shown in FIG. 17A. When detecting that paper P stacked on the bottom board 11*b* is greater than or equal to a certain height, the height position detecting sensor SE3 may output information indicating this detection to the counter 33. Subsequently, the counter 33 may obtain information indicating that ink has been ejected to the sheet of paper P, and the counter 33 may count the number of sheets of paper P discharged to the output tray 11. The stacking thickness of paper P may be calculated by multiplying the thickness of a single sheet of paper P by the number of sheets of paper P and adding the certain height detected by the height position detecting sensor SE3.

Figure 17B:
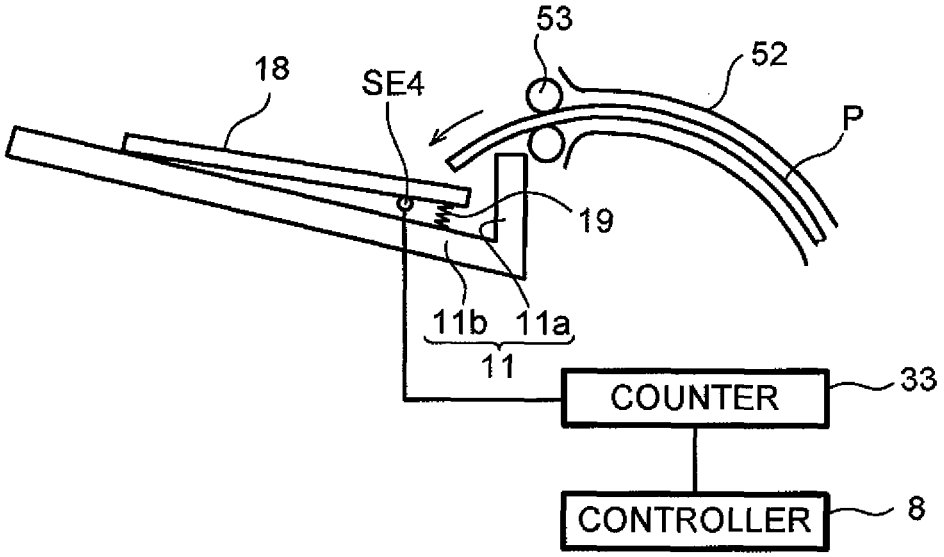
FIG. 17B is a side view that shows a schematic illustration of an output tray and a measuring device with a displacement detecting sensor.

In still yet another configuration, the "measuring device" may comprise a receiver 18, which may be attached to the bottom board 11*b* of the output tray 11, such that one end of the receiver 18 may pivot and the other end of the receiver 18 may be urged upward by a spring 19, as shown in FIG. 17B. The receiver 18 may comprise a displacement detecting sensor SE4 that may detect the amount of vertical displacement of the receiver 18, and the displacement detecting sensor SE4 may be connected to the counter 33. When sheets of printed paper P accumulate on the bottom board 11*b*, the weight of the sheets of paper P may cause the receiver 18 to be displaced. An amount of displacement of the receiver 18 may be detected by the displacement detecting sensor SE4, and the displacement detecting sensor SE4 may output the amount of displacement to the counter 33. The counter 33 may comprise a table indicating a relationship between a stacking thickness of paper P and the amount of displacement of the receiver 18, and the counter 33 may calculate the stacking thickness of paper P on the receiver 18 from the amount of displacement detected by the displacement detecting sensor SE4.

Defects that may occur when a sheet of paper P is discharged to the face-up output tray 15 such that the surface on which ink has been ejected may be face-up (e.g., face-up printing) now are described. A sheet of paper P may be discharged to the output tray such that a surface on which ink has been ejected may be face-up. When the sheet of paper P is discharged to the output tray in a manner that does not sufficiently correct a curl occurring in the sheet of paper P, the sheet of paper P may remain curled and the central portion of the sheet of paper P may be bowed upward in the stacking direction (e.g., vertical direction). When many sheets of paper P are stacked on the face-up output tray 15 and the sheet of paper P in the uppermost position and the output port 16 through which paper may be discharged are disposed near to each other, an edge of the curled paper P may block partly the opening 16 (e.g., an edge of the sheet of paper P may cover a portion of the output port 16) when the grain of the sheet of paper P is parallel to the sub-scanning direction. Thus, even when the amount of paper P stacked on the output tray does not reach the upper limit, paper P discharged through the output port 16 may collide with the edge of the sheet of paper P partly blocking the output port 16 and may suffer from a defect, such as bending or warping. When the grain of the sheet of paper P is parallel to the main scanning direction, the likelihood that the edge of the curled paper P may block partly the output port may be low; however, the sheet of paper P stacked on the output tray may be curled such that a central portion thereof may be bowed. Paper P discharged through the output port may be pushed upward by the upwardly bowed portion, may fall outside the output tray, and may suffer from a defect, such as bending, warping, or soiling.

In above-described configurations, a recording medium may comprise an exemplary sheet of paper P. Alternatively or additionally, one or more of a sheet, such as a film or a label, a poster or other recording media in other forms may be used as a recording medium.

The control device 80 in the above-described configurations may comprise one or more of a waiting-time setting device 82 (as shown in FIG. 6) and the curl correcting amount setting device 88 (as shown in FIG. 13). Alternatively or additionally, the control device 80 may be separate from one or more of the waiting-time setting device 82 and the curl correcting amount setting device 88, and the one or more of the waiting-time setting device 82 and the curl correcting amount setting device 88 may be connected to the control device 80.

The controller 8 shown in FIG. 13 may use a waiting time as an exemplary curl correcting amount. Alternatively or additionally, a heating time and heating temperature of the heater 20 may be used as the curl correcting amount. In such a configuration, the temperature may be raised (e.g., when the curl correcting amount is great) while the waiting time may be maintained constant. Alternatively or additionally, a volume of air from the heater 20 to a sheet of paper P may be increased. Alternatively or additionally, a combination of the waiting time and the temperature of the heater may be set as the curl correcting amount.

When the value of the stacking thickness N is less than the threshold stacking thickness, the curl of the sheet of paper P stacked on the output tray 11 may decrease over time or may be reduced by the weight of paper P additionally stacked thereon. Accordingly, when the value of the stacking thickness N is less than the threshold, to the likelihood that paper P may interfere with an operation of discharging paper P to the output tray 11 may be small, even when a degree of correction of a curl may be small, as appropriate (e.g., such that the curl may remain to some extent). Setting the degree of correction of a curl to a small value, as appropriate, when the value of the stacking thickness N is less than the threshold stacking thickness may improve the throughput during printing.

In order to correct curl of the sheet of paper P in certain of the above-described configurations, an ink jet recording apparatus may cause the sheet of paper P to wait in the transport route, and the sheet of paper P may be stretched straight, such that the shape of the sheet of paper P may be retained. The curl of the sheet of paper P may be corrected by rotating the motor M at a reduced speed and transporting the sheet of paper P at a reduced speed, which is less than a normal transport speed. Alternatively or additionally, an ink jet recording apparatus may cause the sheet of paper P to wait or to be transported along the transport route, and the sheet of paper P may be bent, such that, for example, at least part of a surface comprising ink ejected thereon may be bent downwardly by the guide 52 and the guide 52*a*, which may retain the shape of the sheet of paper P. Furthermore, in particular configurations, if the amount of curl occurring in the sheet of paper P is set to a curl value of R1 when the sheet of paper P is discharged to the output tray 11 without being subjected to curl correction, the ink jet recording apparatus may cause the sheet of paper P to wait or to be transported along the transport route, and the sheet of paper P may be bent such that at least part of the surface comprising ink ejected thereon may be bent upwardly, which may correct the shape of the sheet of paper P, such that the sheet of paper P may be bent to a curl angle less than R1. In such configurations, the ink jet recording apparatus may correct the curl of the sheet of paper P.

In the above-described configurations, a single CPU may form the controller 8. Alternatively, one or more of a plurality of CPUs, an application specific integrated circuit ("ASIC"), and a combination of a CPU and an ASIC may form the controller 8. The controller 8 may be implemented through hardware or software stored in a computer-readable medium.

The present invention may comprise a liquid ejecting apparatus comprising a curl correcting device for correcting a curl in a recording medium after image formation.

While the invention may comprise been described in connection with various exemplary structures and illustrative embodiments, it will be understood by those skilled in the art that other variations and modifications of the structures, configurations, and embodiments described above may be made without departing from the scope of the invention. For example, this application comprises possible combinations of the various elements and features disclosed herein, and the particular elements and features presented in the claims and disclosed above may be combined with each other in other ways within the scope of the application, such that the application should be recognized as also directed to other embodiments comprising other possible combinations. Other structures, configurations, and embodiments consistent with the scope of the claimed invention will be apparent to those skilled in the art from a consideration of the specification or practice of the invention disclosed herein. It is intended that the specification and the described examples may be illustrative with the true scope of the invention being defined by the following claims.

What is claimed is:

1. A liquid ejecting apparatus comprising:

a liquid ejection head configured to eject liquid on each piece of at least one piece of recording media;

an output tray configured to support the at least one piece of recording media stacked thereon;

a curl correcting device configured to perform curl correction processing on the each piece of the at least one piece of recording media before the each piece of the at least one piece of recording media is discharged to the output tray, wherein the curl correction processing reduces an amount of curl of the each piece of the at least one piece of recording media;

a detecting device configured to detect information related to a stacking thickness of the at least one piece of recording media stacked on the output tray in a stacking direction thereof; and a controller configured to:

determine whether the stacking thickness is greater than or equal to a threshold stacking thickness based on the information related to the stacking thickness;

set the curl correcting device to perform the curl correction processing on the each piece of the at least one piece of recording media at a first processing level when the stacking thickness is greater than or equal to the threshold stacking thickness, and set the curl correcting device to perform the curl correction processing on the each piece of the at least one piece of recording media at a second processing level when the stacking thickness is less than the threshold stacking thickness, wherein the first processing level comprises a greater amount of curl correction processing than the second processing level.

2. The liquid ejecting apparatus according to claim 1, wherein the first processing level comprises a process of setting a first waiting time during which the each piece of the at least one piece of recording media waits after the liquid ejection head ejects liquid thereon before being discharged to the output tray, wherein the second processing level comprises a process of setting a second waiting time during which the each piece of the at least one piece of recording media waits after the liquid ejection head ejects liquid thereon before being discharged to the output tray, and wherein the first waiting time is greater than the second waiting time.

3. The liquid ejecting apparatus according to claim 1, wherein the controller is further configured to determine the stacking thickness based on the information related to the stacking thickness detected by the detecting device, and wherein the controller is configured to increase the amount of curl correction processing associated with the first processing level when the controller determines that the stacking thickness is increasing.

4. The liquid ejecting apparatus according to claim 1, wherein the controller is further configured to determine the stacking thickness based on the information related to the stacking thickness detected by the detecting device, and wherein the controller is configured to increase the amount of curl correction processing associated with the first processing level when the controller determines that the stacking thickness has increased by at least a particular amount.

5. The liquid ejecting apparatus according to claim 1, further comprising an operation panel configured to receive an input indicating that one of face-down printing and face-up printing is to be performed on the at least one piece of recording media, wherein the controller is configured to increase at least one of the amount of curl correction processing associated with the first processing level and an amount of curl correction processing associated with the second processing level when the operation panel receives an input indicating that the face-down printing is to be performed on the at least one piece of recording media.

6. The liquid ejecting apparatus according to claim 1, wherein the controller is configured to determine whether an amount of liquid to be ejected from the liquid ejection head onto the each piece of the at least one piece of recording media is greater than or equal to a predetermined amount, and wherein the controller is configured to increase at least one of the amount of curl correction processing associated with the first processing level and an amount of curl correction processing associated with the second processing level when the amount of liquid to be ejected from the liquid ejection head onto the each piece of the at least one piece of recording media is greater than or equal to the predetermined amount.

7. The liquid ejecting apparatus according to claim 1, further comprising a memory configured to store image data relating the image to be formed on the each piece of the at least one piece of recording media, wherein the controller is configured to set the amount of curl correction processing associated with at least one of the first processing level and the second processing level based on the image data, wherein the controller is configured to set the amount of curl correction processing associated with at least one of the first processing level and the second processing level based on the stacking thickness, and wherein the controller is configured to set the amount of curl correction processing associated with at least one of the first processing level and the second processing level based on an amount of liquid to be ejected by the liquid ejection head when forming the image on the each piece of the at least one piece of recording media.

8. The liquid ejecting apparatus according to claim 7, wherein the controller is configured to increase the amount of curl correction processing associated with at least one of the first processing level and the second processing level for the each piece of the at least one piece of recording media when image data specifies that an amount of liquid to be ejected by the liquid ejection head onto the each piece near an edge of the each piece is greater than or equal to a predetermined amount.

9. The liquid ejecting apparatus according to claim 1, wherein the curl correcting device comprises a conveying device configured to convey the each piece of the at least one piece of recording media from the liquid ejection head to the output tray while retaining the each piece of the at least one piece of recording media in a curl-correcting shape after the liquid ejection head ejects the liquid onto the each piece of the at least one piece of recording media.

10. The liquid ejecting apparatus according to claim 9, wherein the curl-correcting shape is a shape in which the each piece of the at least one piece of recording media is stretched straight.

11. The liquid ejecting apparatus according to claim 9, wherein the curl-correcting shape is a shape in which the each piece of the at least one piece of recording media is bent such that at least a portion of a surface on which the liquid is ejected is bent downwardly.

12. The liquid ejecting apparatus according to claim 1, wherein the curl correcting device comprises a drying device configured to dry the each piece of the at least one piece of recording media while retaining the each piece of the at least one piece of recording media in a curl-correcting shape after the liquid ejection head ejects the liquid onto the each piece of the at least one piece of recording media.

13. The liquid ejecting apparatus according to claim 12, wherein the curl-correcting shape is a shape in which the each piece of the at least one piece of recording media is stretched straight.

14. The liquid ejecting apparatus according to claim 1, wherein the detecting device comprises:

a rotation center shaft;

an arm configured to rotate about the rotation center shaft, wherein the arm is further configured to contact an uppermost piece of the at least one piece of recording media stacked on the output tray in the stacking direction; and an angle sensor configured to detect an angle between the arm and a reference line as the information related to the stacking thickness of the at least one piece of recording media.

15. The liquid ejecting apparatus according to claim 1, further comprising:

wherein the output tray comprises:

a support tray comprising an upper surface configured to contact a bottom-most piece of the at least one piece of the at least one piece of recording media in the stacking direction; and a wall adjacent to the support tray, and wherein the detecting device comprises:

a position detecting sensor disposed at a particular position at the wall and configured to detect, as the information related to the stacking thickness of the at least one piece of recording media, whether the at least one piece of recording media stacked on the output tray in the stacking direction is stacked to the particular position at the wall.

16. A method for correcting a curl with a liquid ejecting apparatus comprising a liquid ejection head configured to eject liquid on each piece of at least one piece of recording media, an output tray configured to support the at least one piece of recording media stacked thereon, a curl correcting device configured to perform curl correction processing on the each piece of the at least one piece of recording media before the each piece of the at least one piece of recording media is discharged to the output tray, a detecting device configured to detect information related to a stacking thickness of the at least one piece of recording media stacked on the output tray in a stacking direction thereof, the method comprising the steps of:

determining whether the stacking thickness is greater than or equal to a threshold stacking thickness based on the information related to the stacking thickness;

setting the curl correcting device to perform the curl correction processing on the each piece of the at least one piece of recording media at a first processing level when the stacking thickness is greater than or equal to the threshold stacking thickness; and setting the curl correcting device to perform the curl correction processing on the each piece of the at least one piece of recording media at a second processing level when the stacking thickness is less than the threshold stacking thickness, wherein the curl correction processing reduces an amount of curl of the each piece of the at least one piece of recording media, and wherein the first processing level comprises a greater amount of curl correction processing than the second processing level.

17. A non-transitory, computer-readable medium storing computer-readable instructions therein that, when executed by a processor of a liquid ejecting apparatus comprising a liquid ejection head configured to eject liquid on each piece of at least one piece of recording media, an output tray configured to support the at least one piece of recording media stacked thereon, a curl correcting device configured to perform curl correction processing on the each piece of the at least one piece of recording media before the each piece of the at least one piece of recording media is discharged to the output tray, a detecting device configured to detect information related to a stacking thickness of the at least one piece of recording media stacked on the output tray in a stacking direction thereof, instructs the processor to execute the steps of:

determining whether the stacking thickness is greater than or equal to a threshold stacking thickness based on the information related to the stacking thickness;

setting the curl correcting device to perform the curl correction processing on the each piece of the at least one piece of recording media at a first processing level when the stacking thickness is greater than or equal to the threshold stacking thickness; and setting the curl correcting device to perform the curl correction processing on the each piece of the at least one piece of recording media at a second processing level when the stacking thickness is less than the threshold stacking thickness, wherein the curl correction processing reduces an amount of curl of the each piece of the at least one piece of recording media, and wherein the first processing level comprises a greater amount of curl correction processing than the second processing level.

18. A liquid ejecting apparatus comprising:

a liquid ejection head configured to eject liquid on each piece of at least one piece of recording media;

an output tray configured to support the at least one piece of recording media stacked thereon;

a curl correcting device configured to perform curl correction processing on the each piece of the at least one piece of recording media before the each piece of the at least one piece of recording media is discharged to the output tray, wherein the curl correction processing reduces an amount of curl of the each piece of the at least one piece of recording media;

a position determining device configured to determine position information of an uppermost piece of the at least one piece of recording media stacked on the output tray in a stacking direction; and a controller configured to:

determine whether the uppermost piece is at a level of or above the level of a particular position based on the position information of the uppermost piece;

set the curl correcting device to perform the curl correction processing on the each piece of the at least one piece of recording media at a first processing level when the uppermost piece is at the level of or above the level of the particular position, and set the curl correcting device to perform the curl correction processing on the each piece of the at least one piece of recording media at a second processing level when the uppermost piece is below the level of the particular position, wherein the first processing level comprises a greater amount of curl correction processing than the second processing level.

* * * * *